US008423278B2

(12) United States Patent
Kondo et al.

(10) Patent No.: US 8,423,278 B2
(45) Date of Patent: Apr. 16, 2013

(54) NAVIGATION AID METHOD, DEVICE AND PROGRAM

(75) Inventors: Motoji Kondo, Nishinomiya (JP); Katsuyuki Yanagi, Nishinomiya (JP); Takashi Inaoka, Nishinomiya (JP)

(73) Assignee: Furuno Electric Company Limited, Nishinomiya (JP)

( * ) Notice: Subject to any disclaimer, the term of this patent is extended or adjusted under 35 U.S.C. 154(b) by 656 days.

(21) Appl. No.: 12/621,284

(22) Filed: Nov. 18, 2009

(65) Prior Publication Data

US 2010/0153013 A1 Jun. 17, 2010

(30) Foreign Application Priority Data

Nov. 19, 2008 (JP) ..... 2008-295654

(51) Int. Cl.
*G06F 17/10* (2006.01)

(52) U.S. Cl.
USPC ..... 701/301; 701/21; 701/532; 701/302; 701/408; 701/432; 701/412; 701/469; 701/472; 701/485; 342/41; 342/176; 342/95

(58) Field of Classification Search ..... 701/21, 701/532, 301, 408; 342/41, 176, 95
See application file for complete search history.

(56) References Cited

U.S. PATENT DOCUMENTS

| | | | | |
|---|---|---|---|---|
| 5,291,899 | A * | 3/1994 | Watanabe et al. | 600/561 |
| 6,212,132 | B1 * | 4/2001 | Yamane et al. | 367/180 |
| 6,424,370 | B1 * | 7/2002 | Courtney | 348/143 |
| 6,836,129 | B2 * | 12/2004 | Lee | 324/690 |
| 7,089,094 | B2 * | 8/2006 | Yanagi | 701/21 |
| 7,750,840 | B2 * | 7/2010 | Wood et al. | 342/95 |
| 2004/0100295 | A1 * | 5/2004 | Lee | 324/761 |
| 2006/0290562 | A1 * | 12/2006 | Ehresman | 342/41 |
| 2007/0185644 | A1 * | 8/2007 | Hirose | 701/200 |

FOREIGN PATENT DOCUMENTS

| | | | |
|---|---|---|---|
| JP | 9-287976 | A | 11/1997 |
| JP | 2005-289284 | A | 10/2005 |

* cited by examiner

*Primary Examiner* — Redhwan K Mawari
(74) *Attorney, Agent, or Firm* — Birch, Stewart, Kolasch & Birch, LLP

(57) ABSTRACT

This disclosure provides a navigation aid device that includes a calculation time setting module for setting two or more calculation points of time for calculating trial information, a ship-concerned information acquisition module for acquiring ship-concerned information including a position of a ship concerned at every predetermined ship-concerned information acquisition time, a ship-concerned trial information calculating module for calculating ship-concerned trial information including the position of the ship concerned at each calculation point of time based on the ship-concerned information acquired at the newest information acquisition time with respect to the calculation point of time.

19 Claims, 32 Drawing Sheets

NAVIGATION AID METHOD, DEVICE AND PROGRAM

CROSS-REFERENCE TO RELATED APPLICATION(S)

This application claims priority under 35 U.S.C. §119 to Japanese Patent Application No. 2008-295654, which was filed on Nov. 19, 2008, the entire disclosure of which is hereby incorporated by reference.

TECHNICAL FIELD

The present invention relates to a navigation aid method, device, and program for aiding navigation by calculating and displaying a spatial relationship between a ship and a target object on a course of the ship while the ship is traveling.

BACKGROUND

Normally, a ship displays, based on information acquired from a radar device, a positioning device, an azimuth detection device and the like equipped on the ship and information acquired from an Automatic Identification System (AIS) equipped on another ship, positions, speeds, and moving directions of the ship concerned and another ship by a display module of the radar device or an Automatic Radar Plotting Aids (ARPA). The ARPA displays the position and the moving direction of another ship with respect to the information on the ship concerned by the display module, and automatically issues an alert when a danger situation, such as a possible collision with another ship, occurs.

For the traveling of the ship concerned, if coastlines and non-route ocean areas are also included in the obstacle object to be considered, information which benefits the navigation, such as nautical chart information and non-route ocean area information may also be required. Ship operators are requested to perform a check of a collision preventive action requirement, which is to check whether the ship concerned should take a collision preventive action against the obstacle object, such as another ship, a coastline, and a non-route ocean area, which can be an obstacle to the traveling of the ship concerned (hereinafter, referred to as an "obstacle candidate"). The ship operators are also required to evaluate and check the validity over selection of a course, a speed and the like for collision-prevention (hereinafter, referred to a "collision preventive action plan"). For this reason, a simulation calculation for estimating a spatial relationship between the ship concerned and the target object, such as another ship, which can be as an obstacle to the ship concerned in future is typically performed (hereinafter, referred to as "trial calculation"). The result is displayed by a display module to allow the ship operators to perform the above-described check.

A conventionally common display method for navigation is shown in FIG. 1 (hereinafter, referred to as a "normal display mode"). Here, a display example according to the heading-up method centering on a ship concerned S is shown. Normally, ship operators perform observation for safe traveling based on such a display screen or displayed information. A trial calculation for checking the collision preventive action requirement and evaluating or checking the collision preventive action plan is performed, if needed.

However, for an obstacle candidate which is located long-distance from the ship concerned (which is indicated as an image far away from the canter of the display screen), it may be difficult to accurately determine whether it is an obstacle candidate just by seeing the screen unless the ship concerned approaches closer to the obstacle candidate. On the crowded route, because many obstacle candidates are typically displayed, it is a great burden for the ship operators to find a true obstacle object quickly and accurately from the displayed information under such a situation.

In order to reduce the burden, the ARPA issues a collision alert automatically. Note that there are some errors in the speed and the moving direction of the ship concerned, the position of the obstacle candidate detected by the radar device, and the position and speed information of other ships acquired from the Automatic Identification Systems equipped on the other ships, respectively. Therefore, it is desired to provide another innovative navigation aid system in addition to the ARPA alert.

Further, the ship operators have to determine an obstacle object quicker and accurately on the course of the ship concerned from two or more images (i.e., two or more obstacle candidates) displayed on the display, and then have to determine when to perform what kind of course change and speed change are to be made against the obstacle objects. That is, an effective device for aiding such determination by the ship operators is desired.

For the art relevant to the above described technique, the art disclosed in JP 2005-289284(A) is known. A configuration of this art is shown in FIG. 2 and its flowchart is shown in FIG. 3. Based on a course and a speed of another ship and based on a course and a speed of the ship concerned, a possible area where the ship concerned will collide with another ship is calculated as a "disturbed zone." This calculation result is displayed so that the distance and the azimuth of the disturbed zone with respect to the ship concerned and the estimated time of arrival (ETA) at the disturbed zone are comprehensible. If the disturbed zone is found, as a test traveling simulation for evading maneuver, a course change and a speed of the ship concerned are inputted, the results are then displayed, and thereby a route to evade the disturbed zone can be displayed as shown in FIG. 4.

The art disclosed in JP 1997-287976(A) performs a trial calculation for estimating positions of the ship concerned and another ship for every predetermined lapsed time when the ship concerned is traveling according to the collision preventive action plan for evading maneuver, and displays the result. Thereby, the validity of the collision preventive action plan is evaluated and checked.

As shown in FIG. 4, the display method disclosed in JP 1997-287976(A) calculates and displays positions of the ship concerned and another ship for every lapsed time $t(i)=t(\mathbf{0})+\Delta t$ (here, $i=1, 2 \ldots$). Here, $t(\mathbf{0})$ is a start time of the collision preventive trial, and $\Delta t$ is a calculation time interval of the trial calculation positions. Normally, a display update period Td for which the display of the positions of the ship concerned and the obstacle is updated at every lapsed time $t(i)$ is set to one to several seconds. Hereafter, the technique for displaying the trial calculation position for every lapsed time $\Delta t$ as shown in FIG. 5 is referred to as a "continuous epoch display method."

Meanwhile, the method of calculating and displaying the estimated positions of the ship concerned and obstacle in future as shown in FIG. 6 is also known. This method displays the estimated positions of the ship concerned and obstacles only during a single predetermined lapsed time after starting a collision preventive action. Hereafter, such a display method is referred to as a "single epoch display method."

Note that the predetermined lapsed time is normally fixed to a time which is determined based on characteristic values, such as a rate of ship's turning (course change rate: degree/second) and a rate of ship speed change (knot/second) stored in advance as transcendental information which are unique to the ship. Specifically, a completion time of the turning is estimated by dividing a difference between the current course and a course set for the collision preventive action by the turning rate, and a completion time of the speed change is estimated by dividing a difference between the current ship speed and a ship speed set for the collision preventive action by the speed change rate. Whichever longer of the turning completion time or the speed change completion time is determined as the predetermined lapsed time.

The art disclosed in JP 2005-289284(A) makes easier the detection for existence of the obstacle to take collision preventive action and the creation of the collision preventive action plan, as well as the distance and azimuth of the disturbed zone and the estimated time of arrival (ETA) at the disturbed zone can be obtained. However, this art cannot grasp the spatial relationship between the ship concerned located at an intermediate position on the course and another ship. Therefore, it is not sufficient to check the validity of how much safely the sip concerned can avoid the obstacle according to the collision preventive action plan (i.e., the settings of the course and speed).

The art disclosed in JP 1997-287976(A) is a continuous epoch display technique in which dynamic relations of positions of the ship concerned and obstacle are displayed in a time-series manner. For this reason, it excels in that the relative position of the ship concerned and obstacle can be visually grasped on a screen and the lapsed time Δt and the display update period Td can be set arbitrarily.

However, it is difficult to carry out the trial calculation (simulation) before and after the time at which the ship operators should most carefully check the safety, that is, the time in future at which the ship concerned S and an obstacle object T1 are expected to approach the closest and before or after that time for acquiring information such as the distance at that time.

When setting an arbitrary future time and calculating and displaying positions of the ship concerned and the target object before and after the future time, there may be a possibility that the calculated future position of the ship concerned and its correct position deviate.

SUMMARY

The present invention is made in view of the above-described situations, and provides a navigation aid method, device, and program that carry out a trial calculation of positions of a ship concerned and an obstacle at a time concerned after setting the time concerned in which a ship operator is interested, under a current traveling condition by which the ship operator determines the necessity for a collision preventive action and a collision preventive action plan (including collision preventive conditions, such as a course, a speed, and a change time of the course and/or speed of the ship) set for the collision preventive action. Thereby, the navigation aid method, device, and program can calculate and display positional information on the ship concerned and a spatial relationship between the ship concerned and the target object other than the ship concerned with a sufficient accuracy as possible.

According to an aspect of the invention, a navigation aid device includes a calculation time setting module for setting two or more calculation points of time for calculating trial information, a ship-concerned information acquisition module for acquiring ship-concerned information including a position of a ship concerned at every predetermined ship-concerned information acquisition time, and a ship-concerned trial information calculating module for calculating ship-concerned trial information including the position of the ship concerned at each calculation point of time based on the ship-concerned information acquired at the newest information acquisition time with respect to the calculation point of time.

The navigation aid device may further include a display module for displaying the position of the ship concerned at least one of the calculation points of time among the calculation points of time so as to correspond to the position on a screen, a display time setting module for setting a display point of time at which the position of the ship concerned is displayed so as to correspond to each calculation point of time, and a display control module for causing the display module to display at each display point of time the position of the ship concerned at each calculation point of time corresponding to the display point of time.

The ship-concerned information acquisition module may acquire the ship-concerned information before each display point of time.

The navigation aid device may further include a target-object information acquisition module for acquiring target-object information including a position of a target object other than the ship concerned at every predetermined target-object information acquisition time, and a target-object trial information calculating module for calculating target-object trial information including the position of the target object at each calculation point of time based on the target-object information acquired at the newest information acquisition time with respect to the calculation point of time. The display control module may cause the display module to display at each display point of time the position of the target object at each calculation point of time corresponding to the display point of time.

The target-object information acquisition module may acquire the target-object information before each display point of time.

The navigation aid device may further include an information acquisition control module for controlling whether the ship-concerned information acquisition module and the target-object information acquisition module acquire the ship-concerned information and the target-object information before each display point of time, respectively.

The ship-concerned information may include at least one of a speed and a bearing of the ship concerned.

The target-object information may include at least one of a moving speed and a moving direction of the target object.

The target-object information acquisition module may include a stationary target object memory module for storing a position of a stationary target object, the position of which does not change with time.

The ship-concerned information acquisition module may include a ship-concerned information input module for inputting the ship-concerned information, and a ship-concerned information storing module for storing the ship-concerned information and outputting the ship-concerned information according to a request from the ship-concerned trial information calculating module.

The target-object information acquisition module may include a target-object information input module for inputting the target-object information, and a target-object information storing module for storing the target-object information and outputting the target-object information according to a request from the target-object trial information calculating module.

The navigation aid device may further include an alert determination module for comparing a ship-concerned/target-object relation defined by information including the position of the ship concerned and the position of the target object at each calculation point of time with an alert condition including a predetermined spatial relationship between the ship concerned and the target object, and outputting a signal when the ship-concerned/target-object relation falls under the alert condition.

The ship-concerned/target-object relation may include a course of the ship concerned and a moving direction of the target object in addition to the position of the ship concerned and the position of the target object.

The display module may display the position of the target object fell under the alert condition at a calculation point of time when the ship-concerned/target-object relation falls under the alert condition based on the signal so that the position of the target object can be discriminated form a displayed position of the target object at another calculation point of time.

The calculation time setting module may set the calculation point of time based on a calculation time interval from a calculation start time at which the calculation starts and a calculation start time defined by the reference time and a lapsed time.

The calculation time setting module may set the calculation point of time based on the reference time and a lapsed time from the reference time.

The calculation time setting module may include an object moving module for causing a movement of a peripheral part of a cylindrical or spherical object in response to an external force being applied, and a time setting module for setting the lapsed time and the calculation time interval corresponding to an amount of the movement to set the calculation point of time.

According to another aspect of the invention, a navigation aid method includes setting two or more calculation points of time for calculating trial information, acquiring ship-concerned information including a position of a ship concerned at every predetermined ship-concerned information acquisition time, calculating ship-concerned trial information including the position of the ship concerned at each calculation point of time based on the ship-concerned information acquired at the newest information acquisition time with respect to the calculation point of time, setting a display point of time at which the position of the ship concerned is displayed so as to correspond to each calculation point of time, displaying at each display point of time the position of the ship concerned at each calculation point of time corresponding to the display point of time, and displaying the position of the ship concerned at least one of the calculation points of time among the calculation points of time so as to correspond to a display position.

The navigation aid method may further include acquiring target-object information including a position of a target object other than the ship concerned at every predetermined target-object information acquisition time, and calculating target-object trial information including the position of the target object at each calculation point of time based on the target-object information acquired at the newest information acquisition time with respect to the calculation point of time. The displaying at each display point of time the position of the ship concerned may include displaying at each display point of time the position of the target object at each calculation point of time corresponding to the display point of time.

According to another aspect of the invention, a navigation aid program includes a means for causing a computer to input two or more calculation points of time for calculating trial information, a means for causing the computer to input ship-concerned information including at least one of a position, a speed, and a bearing of a ship concerned at every predetermined ship-concerned information acquisition time, a means for causing the computer to calculate ship-concerned trial information including the position of the ship concerned at each calculation point of time based on the ship-concerned information acquired at the newest information acquisition time with respect to the calculation point of time, a means for causing the computer to input target-object information including at least one of a position, a moving speed, and a moving direction of a target object other than the ship concerned at every predetermined target-object information acquisition time, a means for causing the computer to calculate target-object trial information including the position of the target object at each calculation point of time based on the target-object information acquired at the newest information acquisition time with respect to the calculation point of time, and a means for causing the computer to display at each display point of time the position of the target object at each calculation point of time corresponding to the display point of time.

BRIEF DESCRIPTION OF THE DRAWINGS

The present disclosure is illustrated by way of example and not by way of limitation in the figures of the accompanying drawings in which the like reference numerals display like elements and in which.

DETAILED DESCRIPTION

Several embodiments of a navigation aid device according to the present invention will be described with reference to the appended drawings.

Embodiment 1

Figure 1:
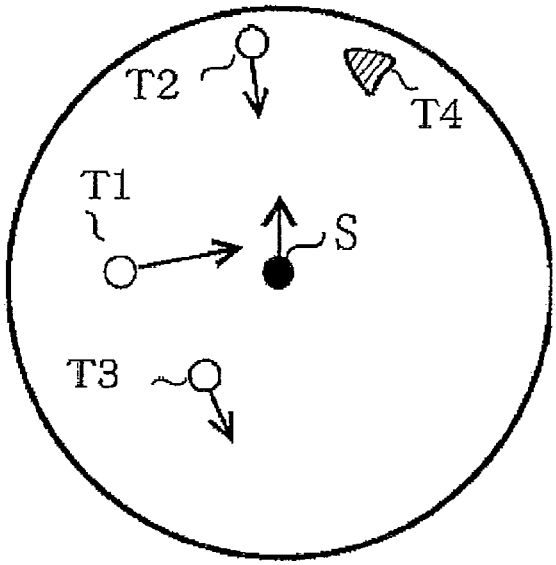
FIG. 1 (Related Art)
FIG. 1 is a view showing a display example according to a conventional common display method for navigation (normal display mode)
Figure 2:
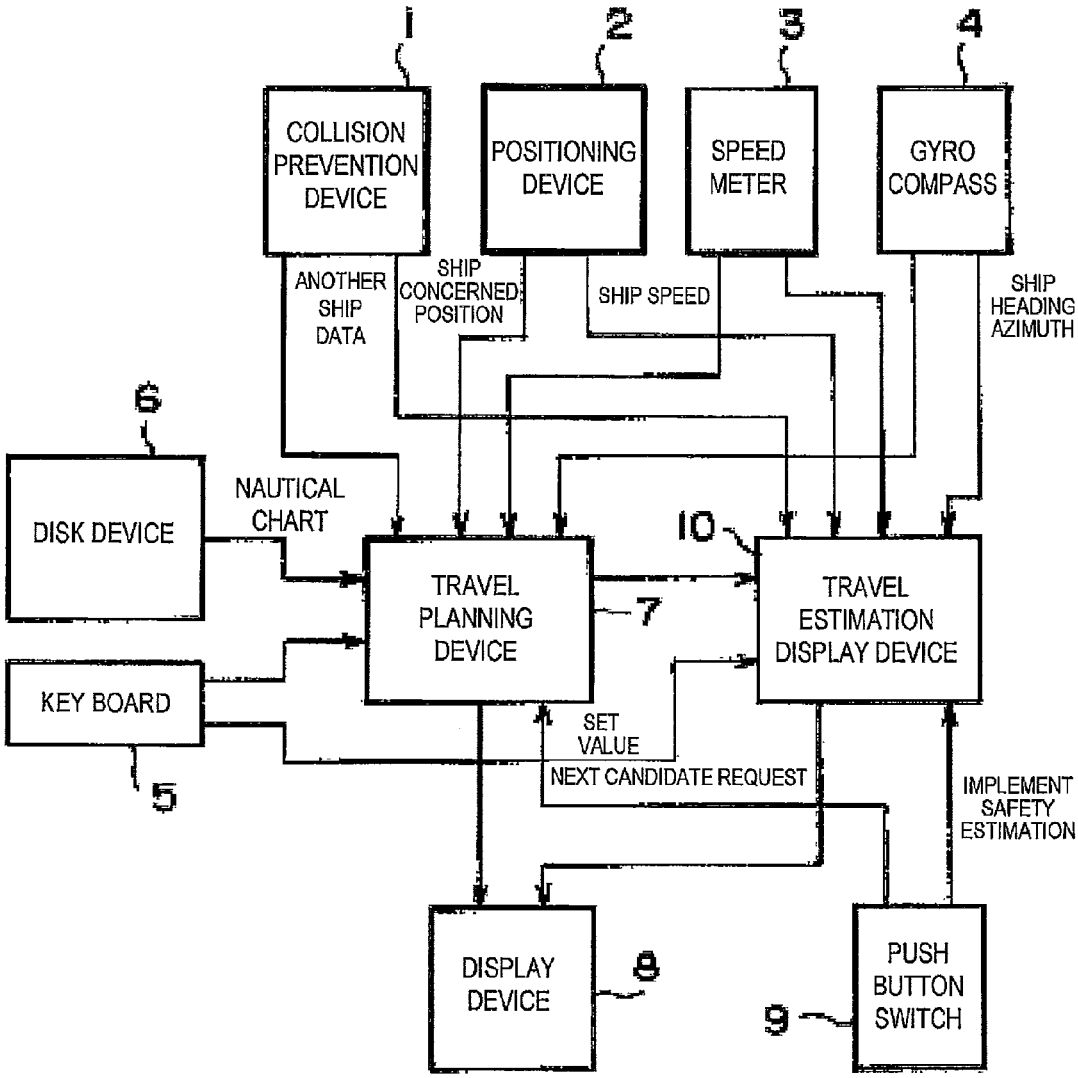
FIG. 2 (Related Art)
FIG. 2 is a view showing a configuration of a conventional navigation aid device.
Figure 3:
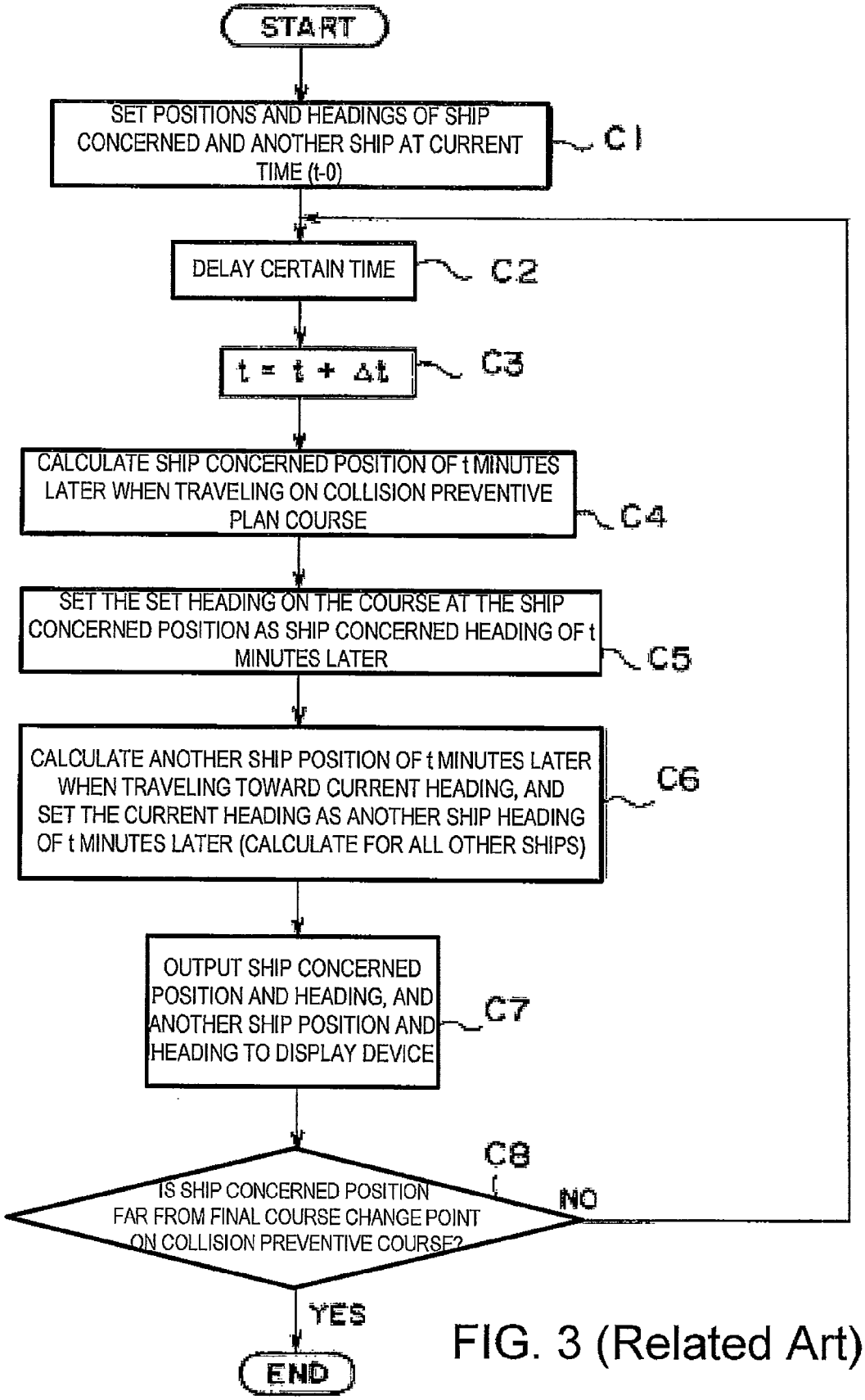
FIG. 3 (Related Art)
FIG. 3 is a flowchart for calculating a position of a ship concerned by the conventional navigation aid device.
Figure 4:
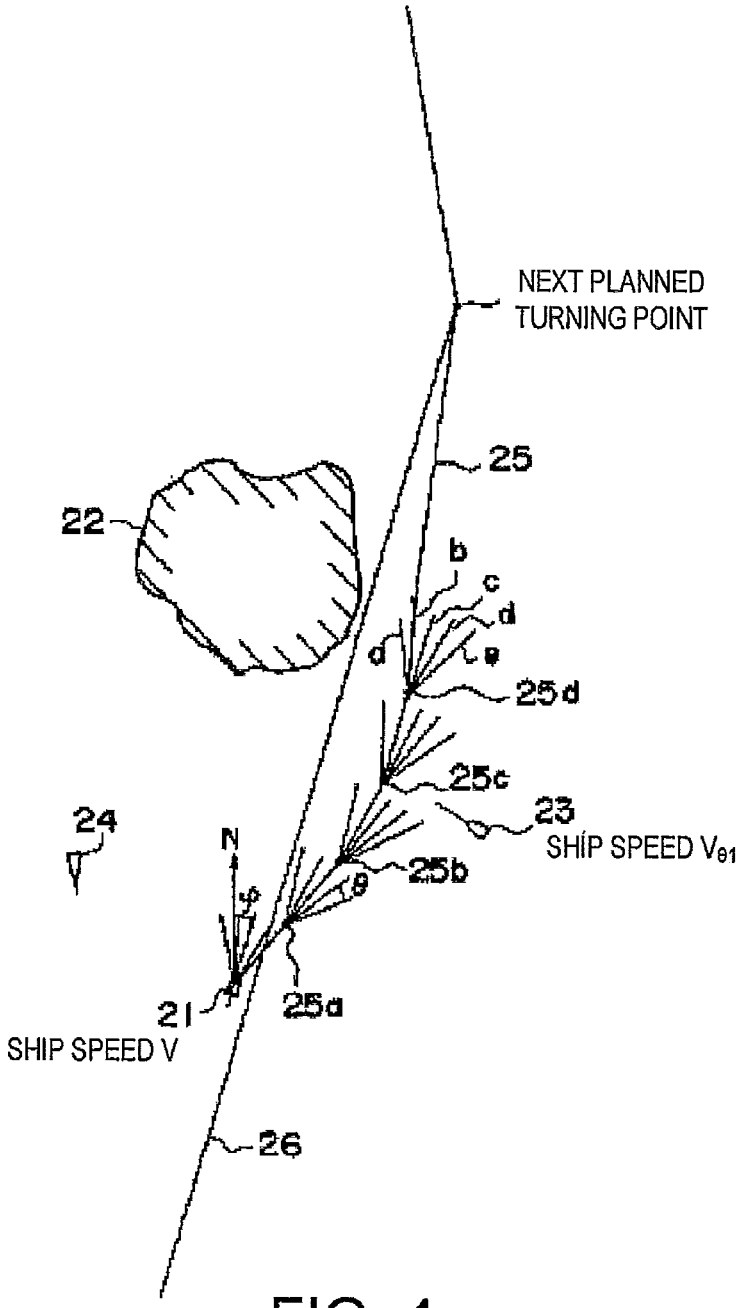
FIG. 4 (Related Art)
FIG. 4 is a view showing a trial calculation result of the position of the ship concerned by the conventional navigation aid device.
Figure 5:
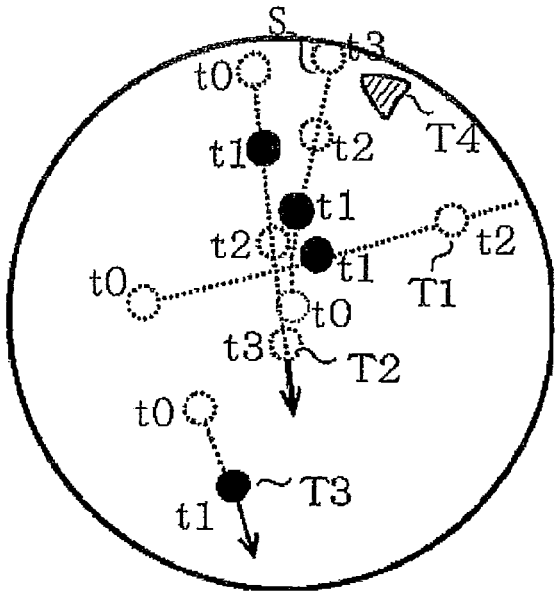
FIG. 5 (Related Art)
FIG. 5 is a view showing a display example according to a continuous epoch display by the conventional navigation aid device.
Figure 6:
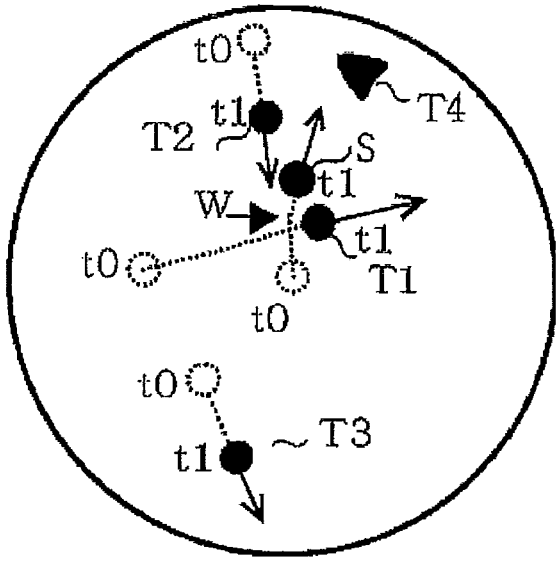
FIG. 6 (Related Art)
FIG. 6 is a view showing a display example according to a single epoch display by the conventional navigation aid device.
Figure 7:
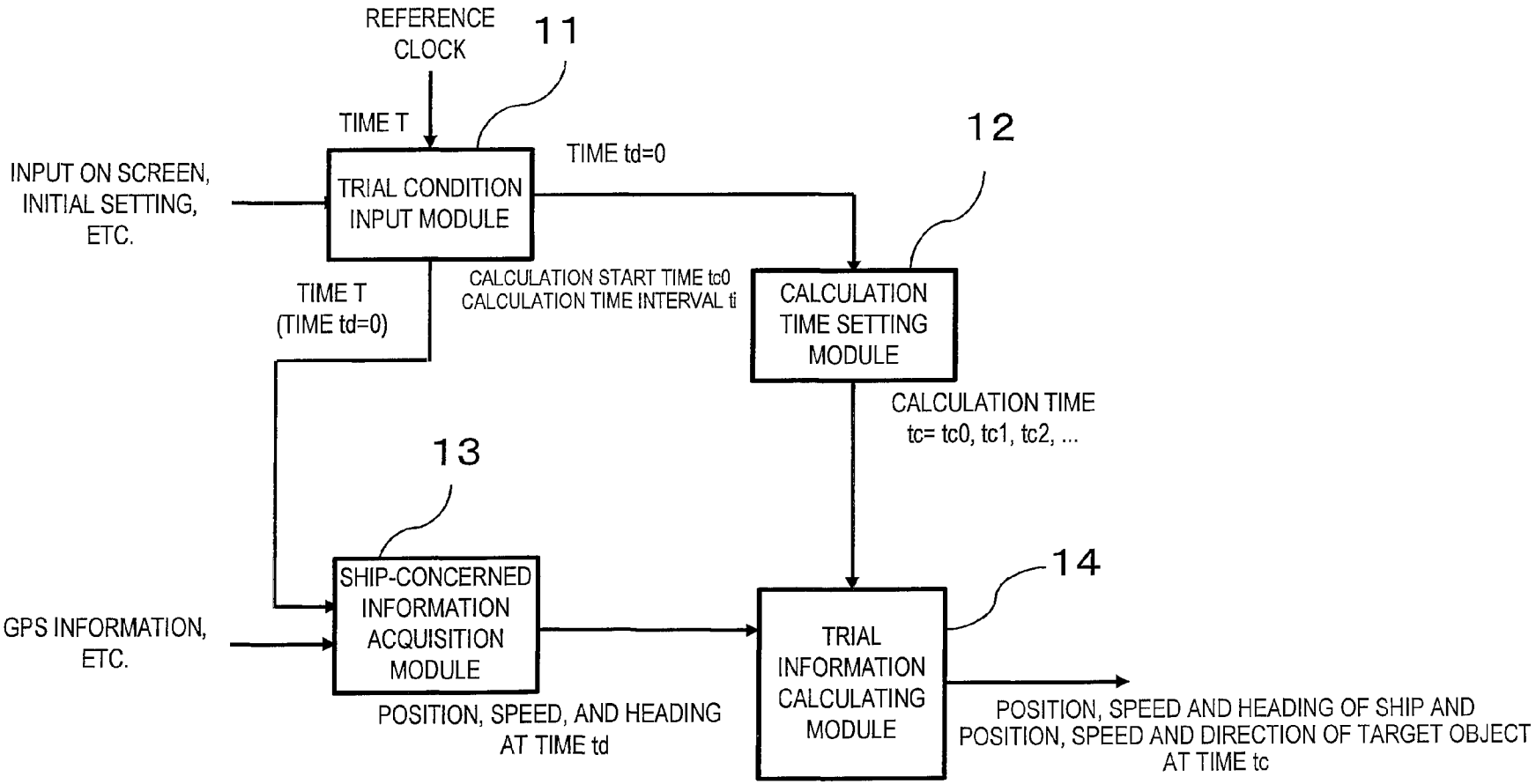
FIG. 7 is a view showing a configuration of a navigation aid device according to Embodiment 1 of the present invention.

FIG. 7 is a view showing a configuration of a navigation aid device according to an embodiment of the present invention. The navigation aid device of this embodiment includes a calculation time setting module 12, a ship-concerned information acquisition module 13, and a trial information calculating module 14, as its most fundamental configuration. The calculation time setting module 12 sets a time, at which information on a future position of a ship concerned is calculated. The ship-concerned information acquisition module 13 acquires information on the ship concerned at a predetermined time, which is necessary for calculation of the information on the position of the ship concerned at each set calculation point of time. The trial information calculating module 14 calculates information on a position of the ship concerned at each calculation point of time described above based on the acquired ship-concerned information. Note that FIG. 7 shows a configuration provided with a trial condition input module 11, this component will be described later.

Figure 8:
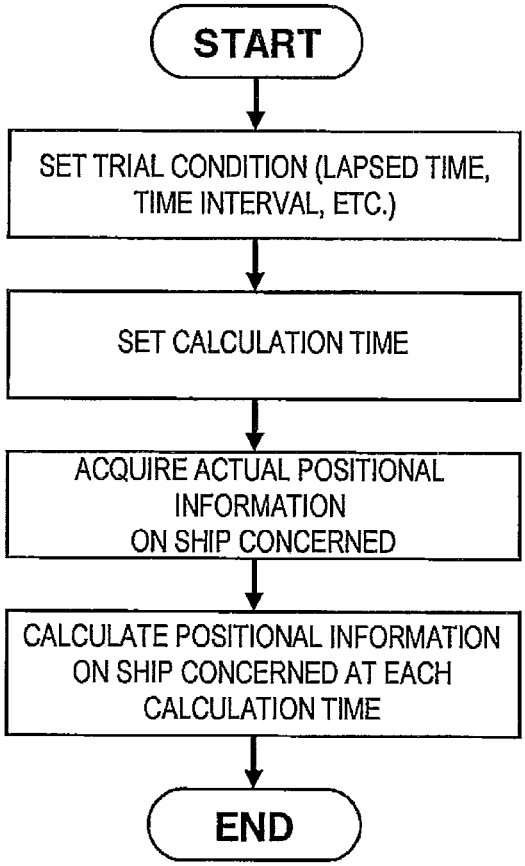
FIG. 8 is a flowchart of positional information calculation according to the navigation aid device of Embodiment 1.

FIG. 8 shows a flowchart of the positional information calculation according to the navigation aid device of this embodiment. First, the calculation time setting module 12 sets a calculation point of time. The calculation point of time is a time at which a future position of the ship concerned is calculated as information necessary for navigation, as described above. Normally, two or more time points are set in order to know the changes in the movement of the ship concerned and its course, instead of a single time point (in the figure, tc=tc0, tc1, tc2, . . . ).

The term used herein "time" may be an absolute time on a certain day of month (i.e., 13:45:56), or may be a relative time after a predetermined time lapsed from the current time or a certain reference time. In any case, the time means a timing to calculate in this embodiment.

The trial condition input module 11 determines how many seconds later a position of the ship concerned will be displayed from a certain reference time T (e.g., current time), and, thus, this time setting is inputted. Of course, the calculation point of time may be determined as a relative time based on the current time as described above, or may be inputted as an absolute time, such as ZULU time or GMT. This serves as the calculation start time.

When a calculation time interval which is an interval of displaying the future position of the ship concerned after the calculation start time in seconds is inputted, the calculation time setting module 12 also sets calculation points of time after the calculation start time (tc=tc0, tc1, tc2, . . . ). The calculation time interval ti may be fixed to a constant value (e.g., a constant interval of 60 seconds). Alternatively, by using an external input device, such as a trackball, a moving length of the perimeter of the trackball and the time interval are made to correspond to each other to appropriately determine each calculation point of time which is at an arbitrary time after the calculation start time.

On the other hand, the ship-concerned information acquisition module 13 acquires ship-concerned information for every predetermined ship-concerned information acquisition time. The ship-concerned information is information necessary for calculation and display of the position of the ship concerned at each set calculation point of time. The information includes, but not limited to, the position, speed, and heading of the ship concerned. When the ship speed changes and the information is known, the information may also be acquired.

The ship-concerned information may include GPS information, and heading and speed information of the ship concerned. These information are acquired at a predetermined time (for example, a predetermined cycle or an absolute time) and are outputted to the trial information calculating module 14. The information may be acquired in response to a request from the trial information calculating module 14 to be outputted to the trial information calculating module 14.

The trial information calculating module 14 calculates information necessary for navigation, such as the position, speed, and heading of the ship concerned, at each calculation point of time set by the calculation time setting module 12 based on the ship-concerned information, as trial information. In this case, if the trial information at all of the predetermined calculation points of time are calculated and displayed at once and, the trial information calculating module 14 may calculate these information based on the same ship-concerned information as having been acquired at a certain single time.

However, in navigation, movement of a target object other than movement of the ship concerned is calculated and displayed to observed a relation between the ship concerned and the target object, such as a relative position and direction. The trial calculation is repeated in many cases while changing the conditions of the ship concerned. The positions of the ship concerned corresponding to all of the calculation points of time may not be calculated at once, but may be calculated at predetermined time intervals. For example, one may desire to display the positions of the ship concerned at the calculation points of time at predetermined time intervals (hereinafter, referred to as "display time intervals").

Even in such a case, it is necessary to consider the positions of the ship concerned and the target object which change every moment and to reduce deviation of the result of the ship concerned at a future time from the actual future position. According to this embodiment, upon calculating the information on the positions of the ship concerned at the calculation points of time, the timing is based on the suitable time for the calculation. Therefore, the trial calculation of the information on the positions of the ship concerned can be carried out based on the newest-acquired ship-concerned information. Thereby, the deviation can be reduced.

Embodiment 2

Figure 9:
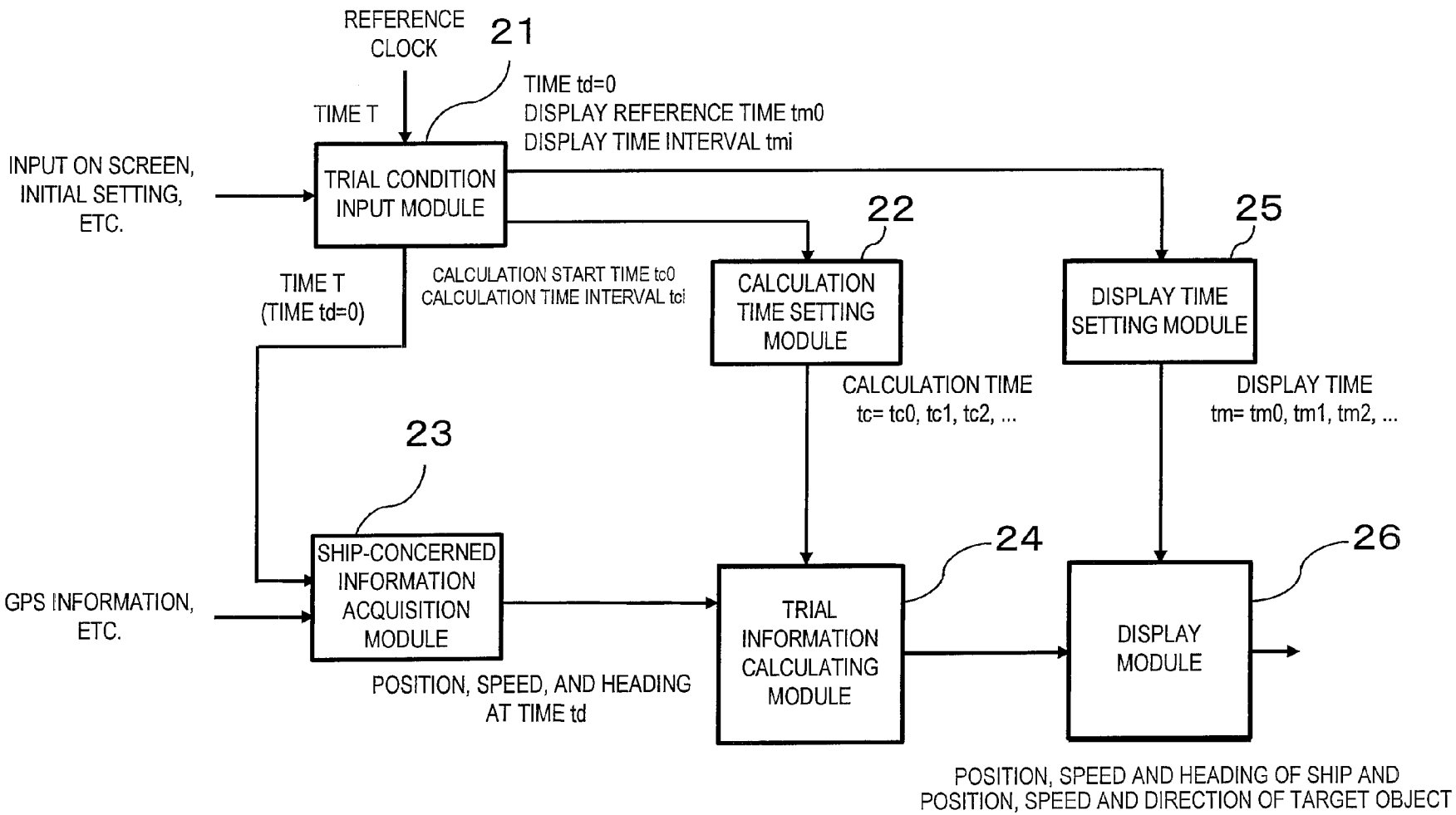
FIG. 9 is view showing a configuration of a navigation aid device according to Embodiment 2 of the present invention.
Figure 10:
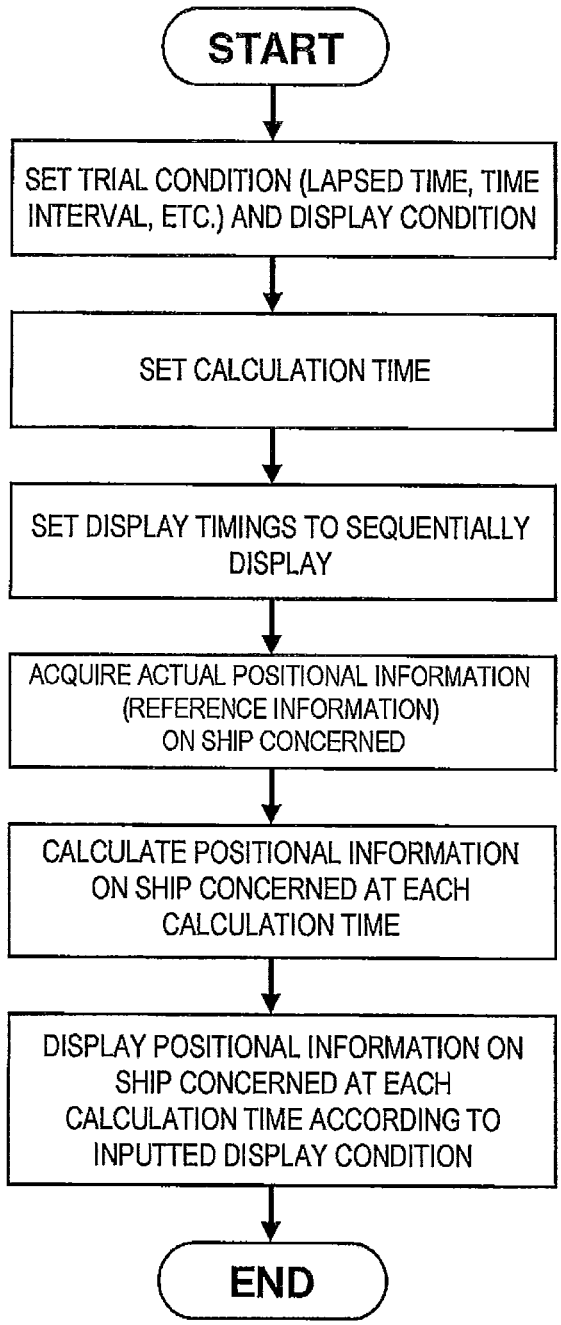
FIG. 10 is a flowchart of positional information calculation according to the navigation aid device of Embodiment 2.

Next, another embodiment of the navigation aid device will be described. FIG. 9 is a view showing a configuration of the navigation aid device of this embodiment, and FIG. 10 is a flowchart showing procedures from an input of trial condition to their display.

The basic configuration of this embodiment is substantially the same as that of the previous embodiment shown in FIG. 7. The navigation aid device of this embodiment additionally includes a display module 26 for displaying the necessary information on the positions of the ship concerned and a display time setting module 25 for setting at which timing the information is displayed by the display module 26. The display point of time (tm=tm0, tm1, tm2, tm3, . . . ) means timing at which a future position of the ship concerned which keeps traveling is calculated by the trial calculation and is then displayed.

Figure 11:
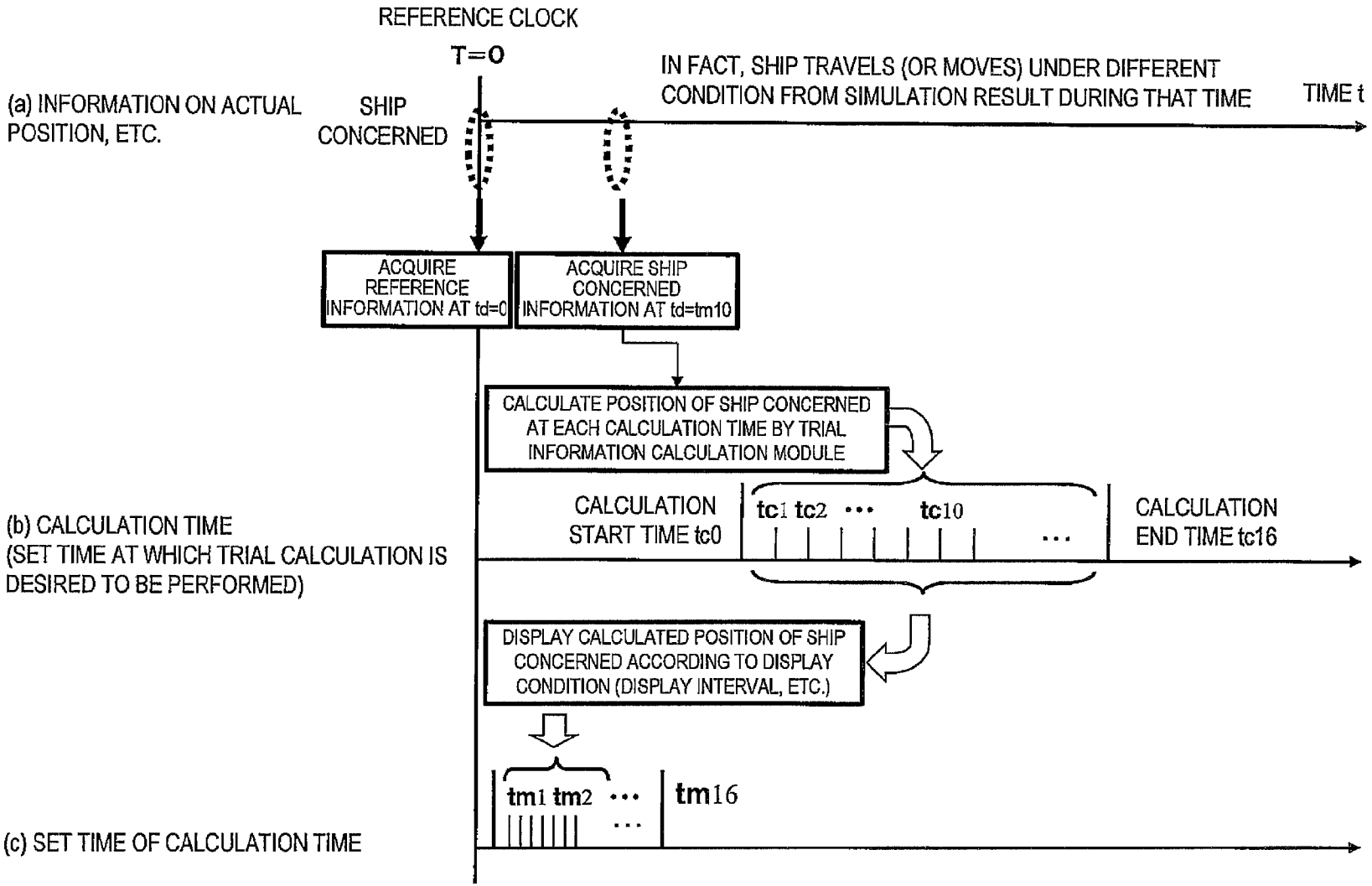
FIG. 11 is a time chart showing a relation of settings of navigation, positional calculation points of time, and display points of time according to the navigation aid device of Embodiment 2.

Referring to FIG. 11, a relation between a calculation point of time tc, a display point of time tm, and a time td at which the ship-concerned information is to be acquired (hereinafter, referred to as a "ship-concerned information acquisition time") is described. Similar to the previous embodiment, predetermined information is inputted in a trial condition input module 21, and calculation points of time tc=tc1, . . . at which the ship operators wants to know future positions of the ship concerned are set in a calculation time setting module 22. The display points of time tmi (i=0, 1, 2 . . . ), at which the positions of the ship concerned are displayed, corresponds to the calculation points of time tci, respectively.

Here, the navigation aid device of this embodiment acquires ship-concerned information at a reference time T=0 (i.e., position, speed, and heading information of the ship concerned which are required to calculate the future position of the ship at a calculation point of time tc). However, in this embodiment, the ship-concerned information is not used for calculation of the future position of the ship concerned at a display point of time tm. For example, at the display point of time tm10, a predetermined time has already passed from the reference time td=0, and at this point, the position of the ship concerned may already be deviated significantly from the actual position. Thus, in this embodiment, information required to calculate the position of the ship concerned at the calculation point of time tc10 corresponding to the display point of time tm10 is acquired again immediately before the display point of time tm10. Based on the ship-concerned information acquired at this time point, i.e., at the ship-concerned information acquisition time td=tm10 (td will be slightly before tm10 because calculation takes a predetermined period of time in fact), the position of the ship concerned at the calculation point of time tc10 is calculated and displayed.

Figure 12:
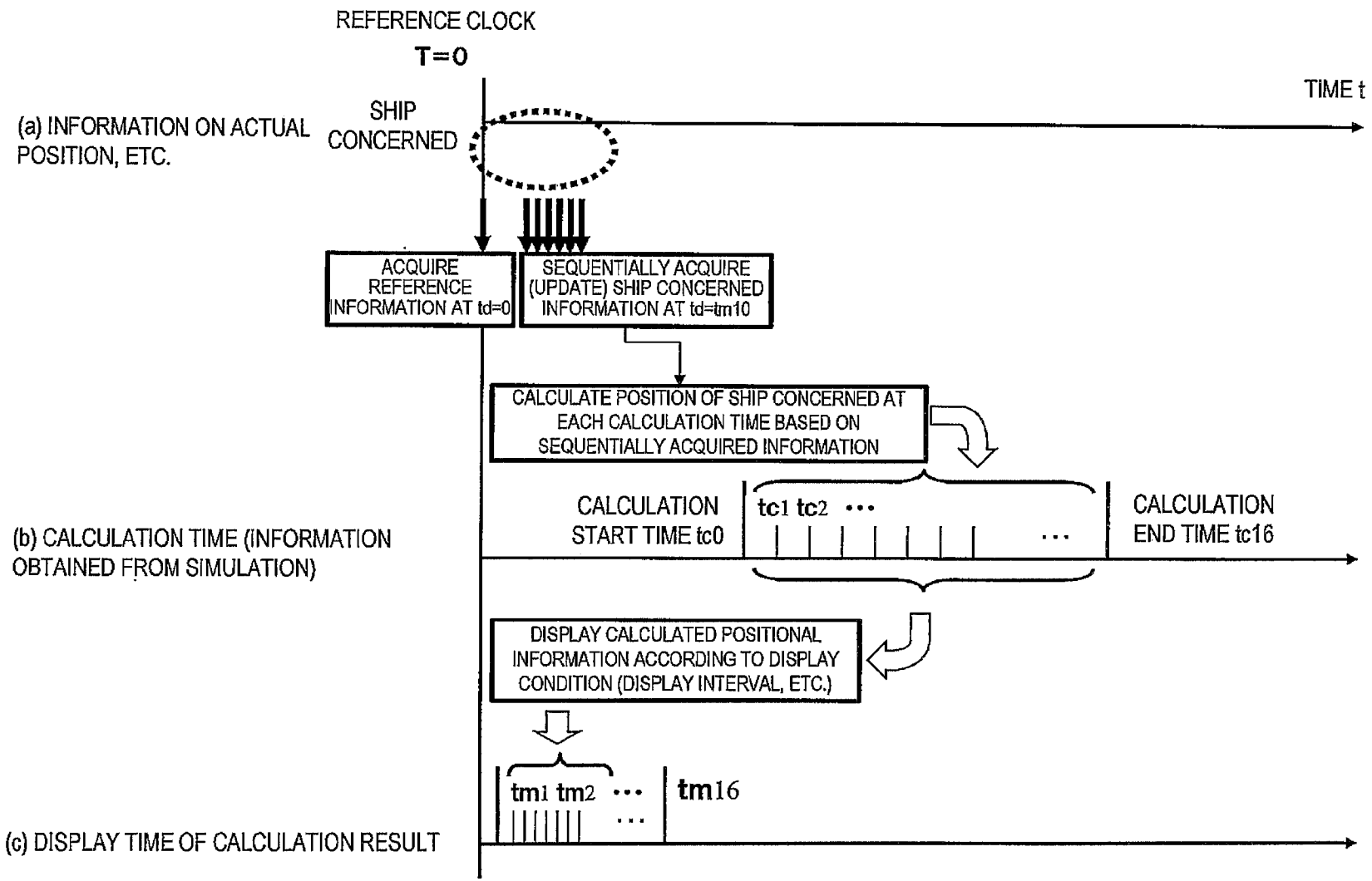
FIG. 12 is a time chart showing a relation of settings of navigation, positional calculation points of time, and display points of time according to the navigation aid device of Embodiment 2 when an acquisition condition is changed.

Next, a modified embodiment of Embodiment 2, in which the setting of the ship-concerned information acquisition time td is changed will be described with reference to FIG. 12. Also in FIG. 12, the configuration of this modified embodiment is substantially the same as that of Embodiment 2 shown in FIG. 9. In FIG. 11 which illustrates the procedures of Embodiment 2, the ship-concerned information is newly acquired again at the time tm10 which passed a certain time; however, in the modified embodiment shown in FIG. 12, the ship-concerned information is time-sequentially acquired corresponding to each display point of time (tm1, tm2, . . . ). The method of setting the ship-concerned information acquisition time td as shown in FIG. 12 can improve the accuracy of the calculated position of the ship concerned at each display point of time.

Although only the positions the ship are described as objects to be calculated and displayed, a speed and a heading of the ship may also be calculated and these information may be combined to be displayed as a vector. Especially, as Embodiment 6 described later, this may be useful when the trial calculation is carried out to display the calculation result while changing a target speed and a target heading of the ship concerned.

Embodiment 3

Figure 13:
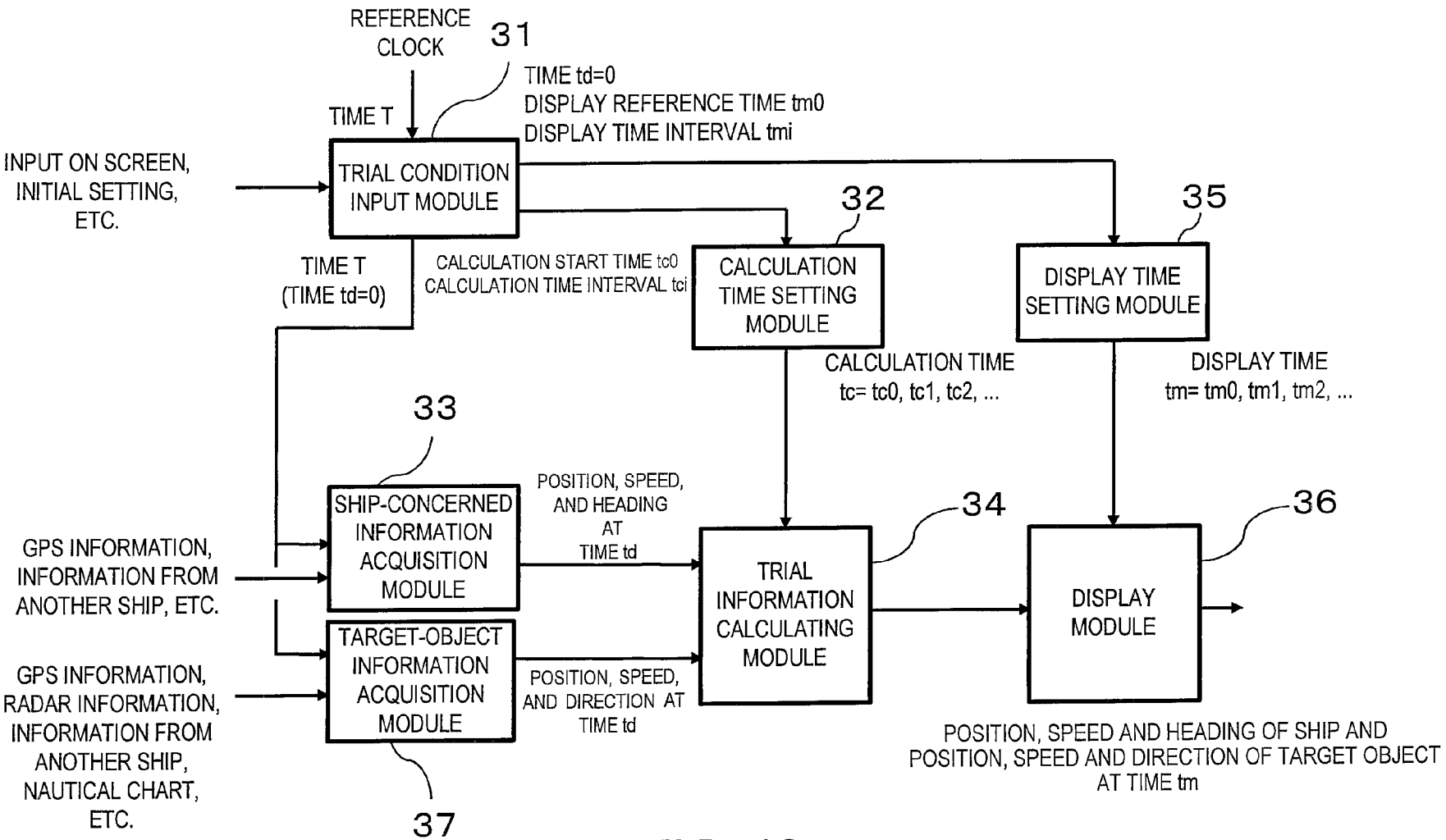
FIG. 13 is a view showing a configuration of a navigation aid device according to Embodiment 3 of the present invention.
Figure 14:
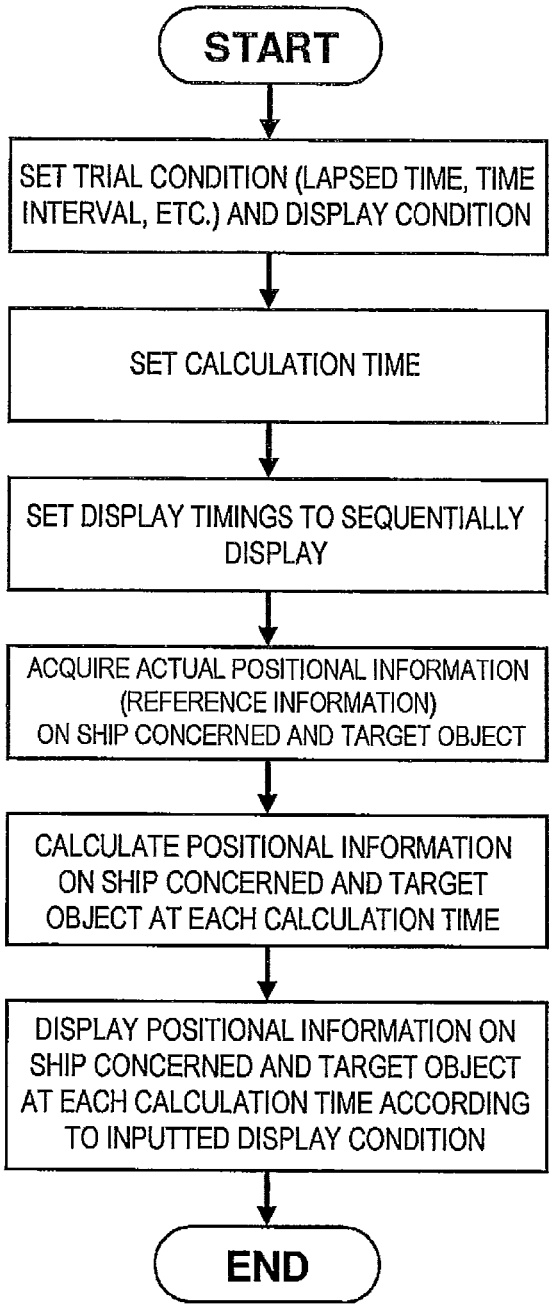
FIG. 14 is a flowchart of positional information calculation according to the navigation aid device of Embodiment 3.

Next, another embodiment of the navigation aid device is described with reference to FIGS. 13 to 16. FIG. 13 is a view showing a configuration of the navigation aid device of this embodiment, and FIG. 14 is a flowchart of positional information calculation according to the navigation aid device of this embodiment.

As shown in FIG. 13, also in this embodiment, a trial condition input module 31, a calculation time setting module 32, a ship-concerned information acquisition module 33, a trial information calculating module 34, a display time setting module 35, and a display module 36 are substantially the same as those of Embodiment 2. This embodiment differs from Embodiment 2 in that it includes a target-object information acquisition module 37 for acquiring information on a target object other than the ship concerned in addition to the ship-concerned information acquisition module 33. The target-object information acquisition module 37 acquires information on a target object other than the ship concerned (for example, another ship) and information on land, such as a port. As shown in FIG. 14, the flowchart is substantially the same as that of Embodiment 2 except that a process for acquiring target-object information is added.

The acquiring information related to the target object includes a moving speed and a moving direction if the target object is a moving object, such as another ship, as well as its position. The information may be detection information by radar equipped on the ship concerned, AIS (Automatic Identification System) information, etc. For a stationary target object, its information may be stored in advance as a nautical chart in a memory.

Figure 15:
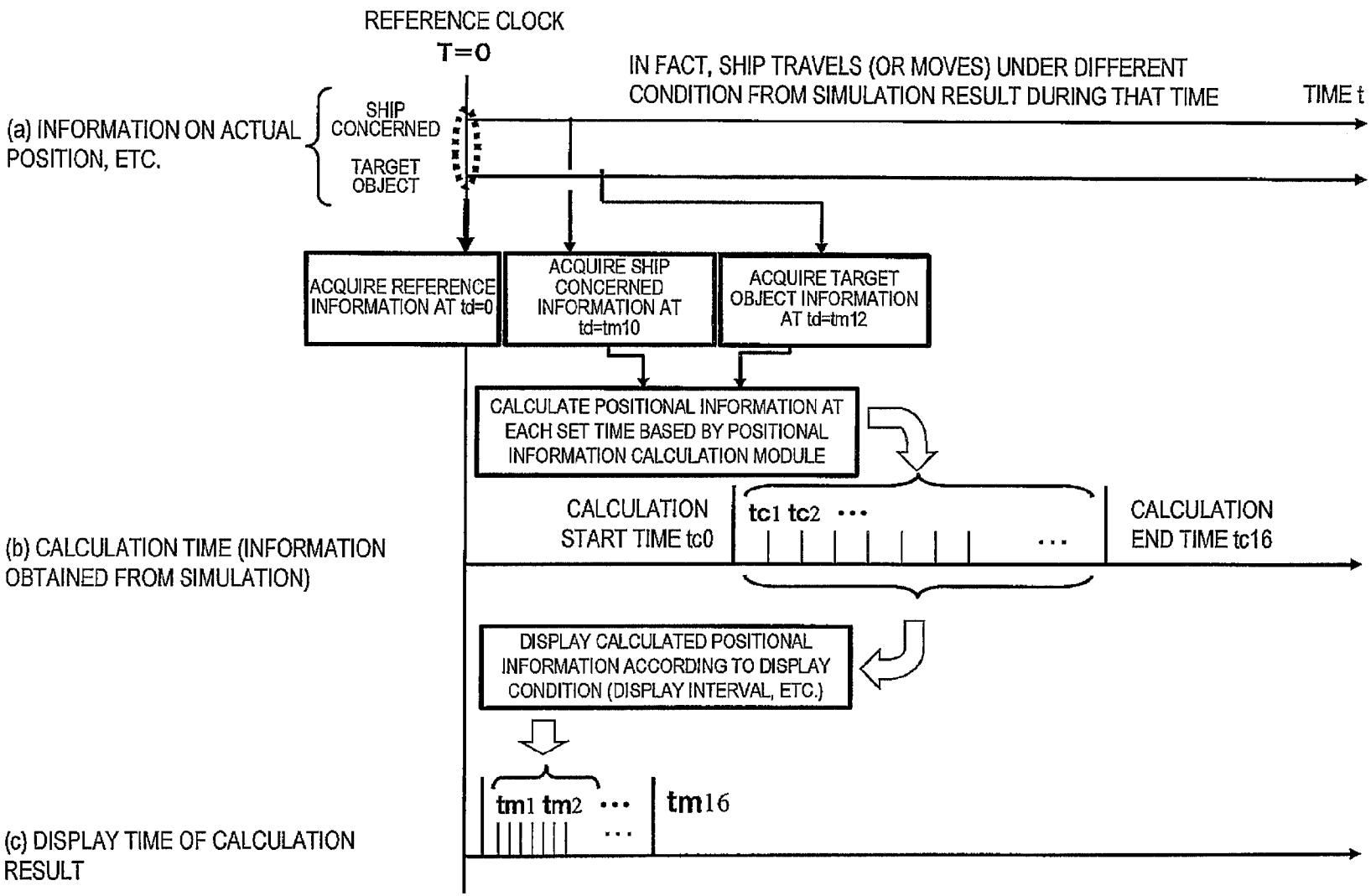
FIG. 15 is a time chart showing a relation of settings of navigation, positional calculation points of time, and display points of time according to the navigation aid device of Embodiment 3.
Figure 16:
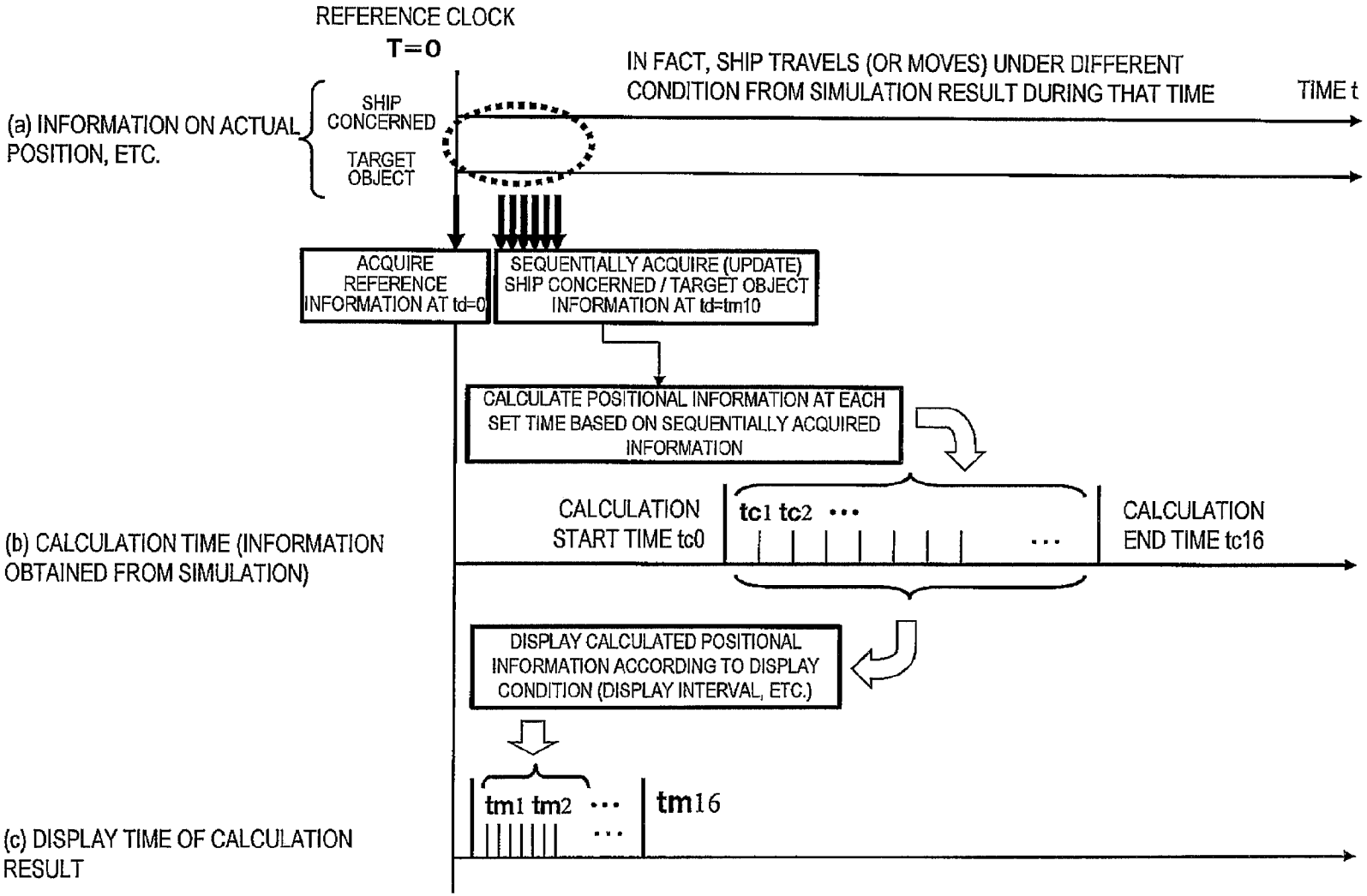
FIG. 16 is a time chart showing a relation of settings of navigation, positional calculation points of time, and display points of time according to the navigation aid device of Embodiment 3.

FIGS. 15 and 16 are time charts for showing a relation of settings of navigation, positional calculation points of time, and display points of time according to the navigation aid device of this embodiment. FIGS. 15 and 16 correspond to FIGS. 11 and 12 showing the time charts of Embodiment 2, respectively. In this embodiment, the target-object information is acquired by the target-object information acquisition module 37 in addition to the ship-concerned information.

In FIG. 15, after the ship-concerned information is acquired at a reference time td=0, the information is again acquired at td=tm10 and the ship-concerned information is then updated. Similarly, although the target-object information is acquired at td=0, it is acquired and updated again at td=tm12.

In this embodiment, for the calculation points of time from tc0 to tc9 corresponding to the display points of time from td=0 to tm9, the positions of the ship concerned and target object are calculated using the ship-concerned information and the target-object information both acquired at td=0. For the display points of time tc10 and tc11, the ship-concerned information updated at tm10 and the target-object information updated at tm0 are used. For tm12 or later time, the ship-concerned information and the target-object information updated at tm12 are used. In this embodiment, although the case where the ship-concerned information acquisition time and the target-object information acquisition time are different from each other is described as an example, they may be the same time.

The time chart shown in FIG. 16 illustrates the acquisition of the ship-concerned information and the target-object information corresponding to the display points of time tmi, similar to Embodiment 2 shown in FIG. 12. If the target-object information updated at every time can be acquired, this can improve the accuracy of the position at each calculation point of time.

Embodiment 4

Figure 17:
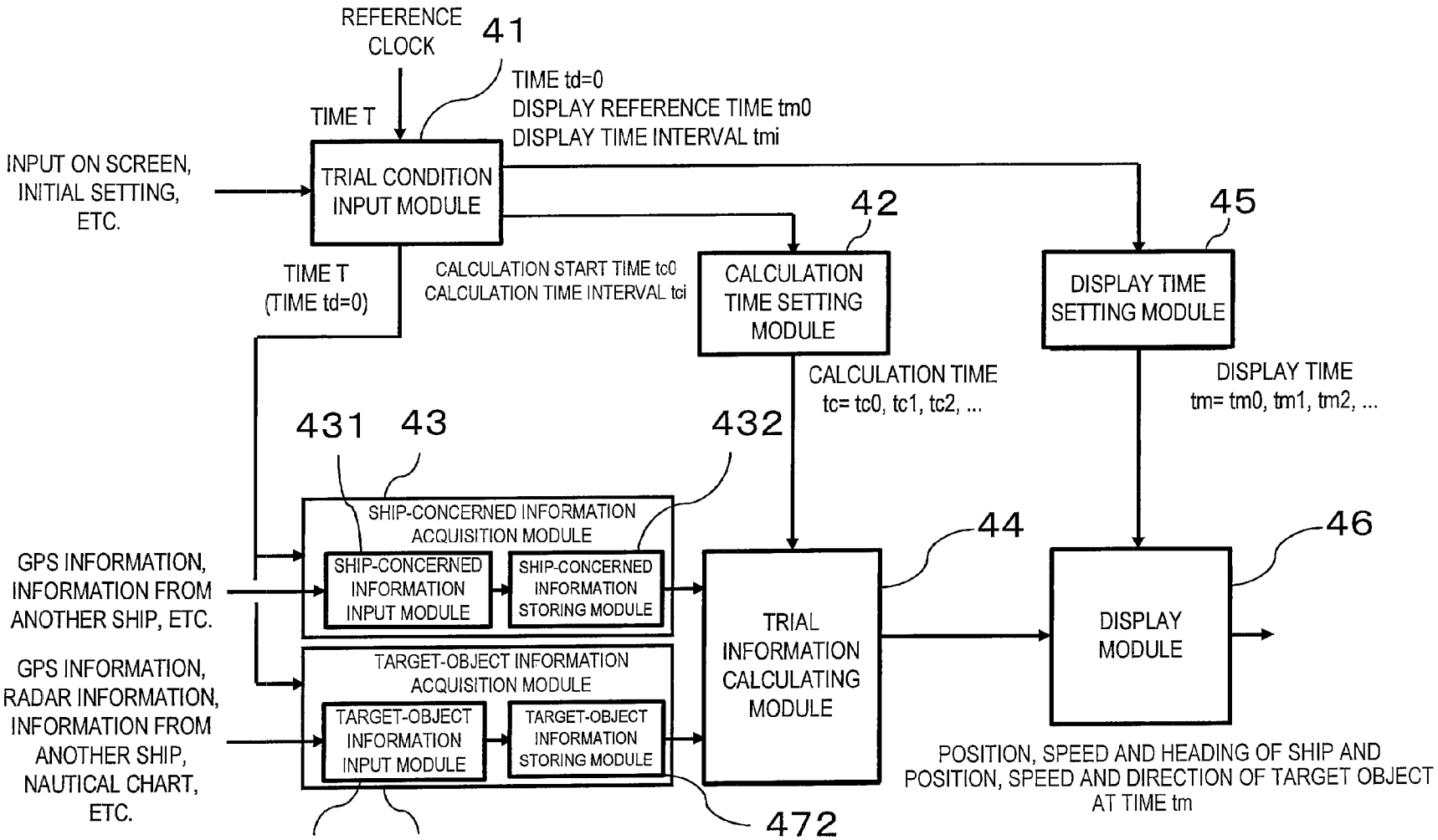
FIG. 17 is a view showing a configuration of a navigation aid device according to of Embodiment 4 of the present invention.
Figure 18:
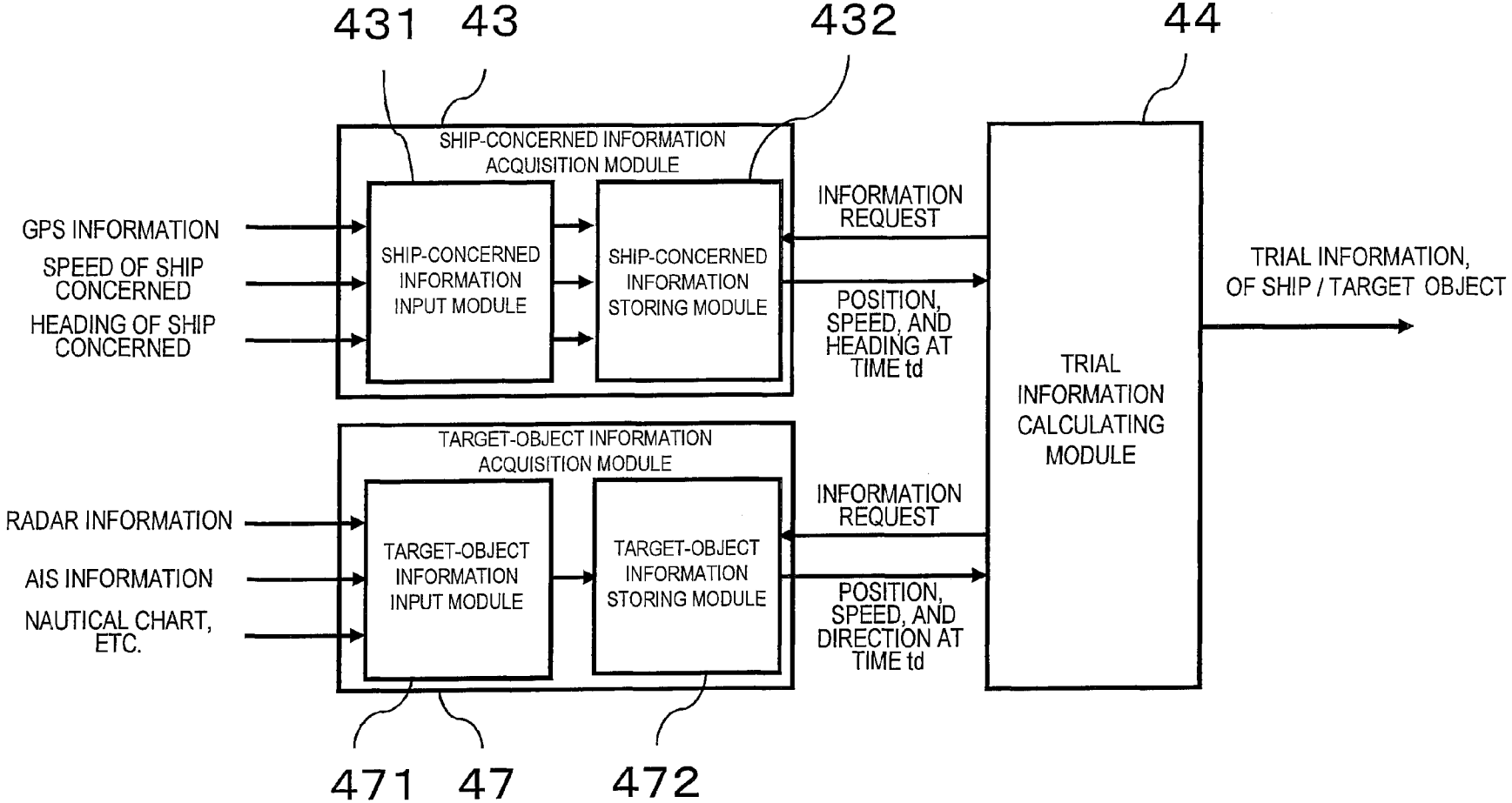
FIG. 18 is a view showing a configuration of a ship-concerned/target-object information acquisition module of the navigation aid device of Embodiment 4.

FIG. 17 is a view showing a configuration of a navigation aid device of this embodiment, and FIG. 18 is a view showing more concretely a configuration of a ship-concerned information acquisition module 43 and a target-object information acquisition module 47. The configuration of this embodiment is substantially the same as the configuration of Embodiment 3, except for the configuration of the ship-concerned information acquisition module 43 and the target-object information acquisition module 47.

In this embodiment, the ship-concerned information acquisition module 43 includes a ship-concerned information input module 431 and a ship-concerned information storing module 432, and the target-object information acquisition module 47 includes a target-object information input module 471 and a target-object information storing module 472. The ship-concerned information input module 431 acquires information on the ship concerned and the target-object information input module 471 acquires target-object information at appropriate timings, respectively.

The ship-concerned information may include GPS (Global Positioning System) information, ship speed and heading information of the ship concerned. For target-object information, such as another ship, it may include detection information by radar equipped on the ship concerned and information by MS (Automatic Identification System) from another ship. For a stationary target object, such as land, the information may include a nautical chart. These information are not necessarily acquired at the same timing but may be acquired at a convenient timing for each. The acquired ship-concerned information and target-object information are stored in the ship-concerned information storing module 432 and the target-object information storing module 472, respectively.

Figure 19:
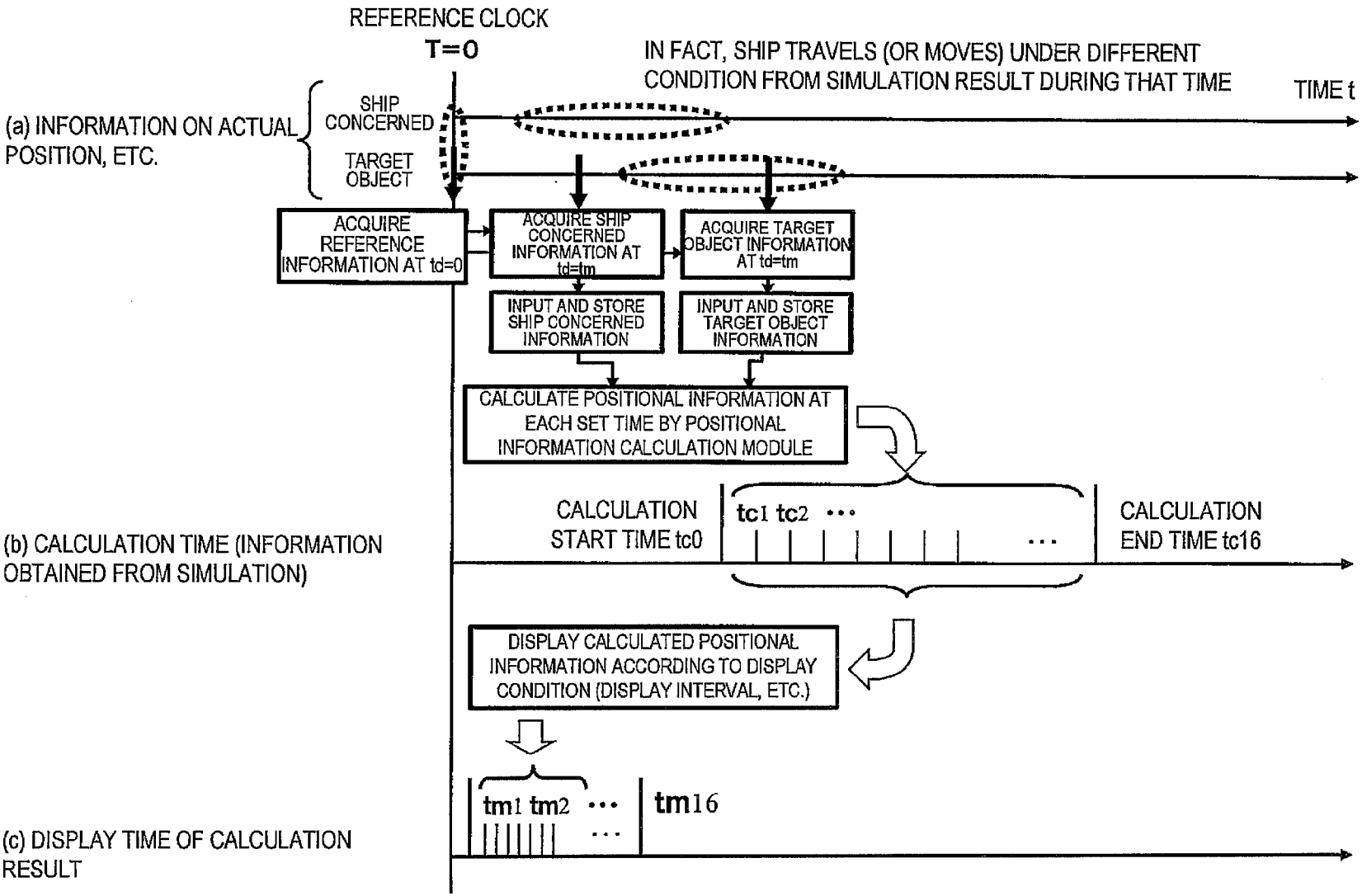
FIG. 19 is a time chart showing a relation of settings of navigation, positional calculation points of time, and display points of time according to the navigation aid device of Embodiment 4.

As shown in FIGS. 18 and 19, for the ship-concerned information and the target-object information stored in the ship-concerned information storing module 432 and the target-object information storing module 472, respectively, the latest information are outputted in response to a request from a trial information calculating module 44. By adopting the configuration using such buffer memories, even if there are two or more sources of information, necessary information can be acquired at convenient timings and the trial information can be calculated based on the newest information.

Embodiment 5

Figure 20:
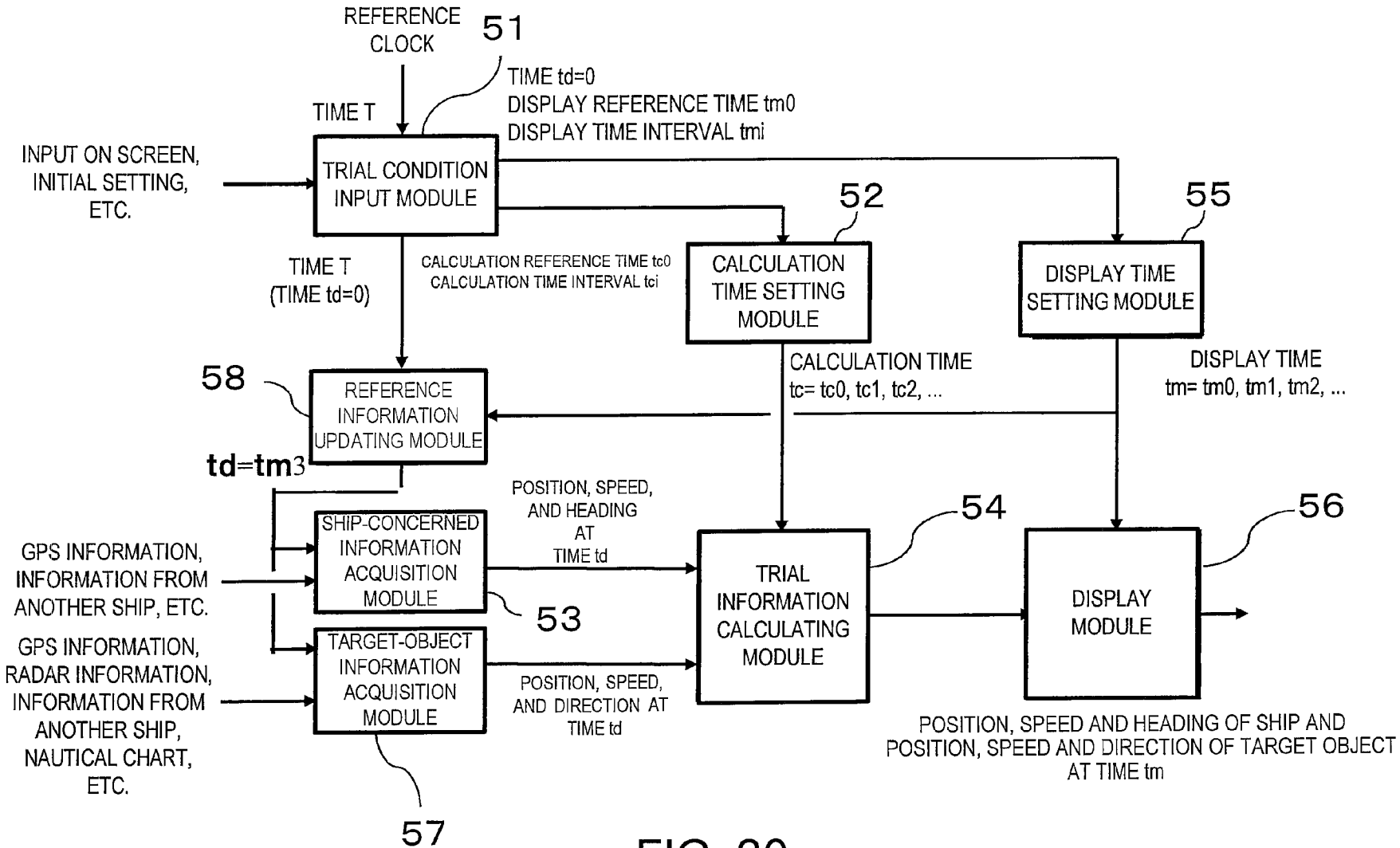
FIG. 20 is a view showing a configuration of a navigation aid device according to Embodiment 5 of the present invention.
Figure 21:
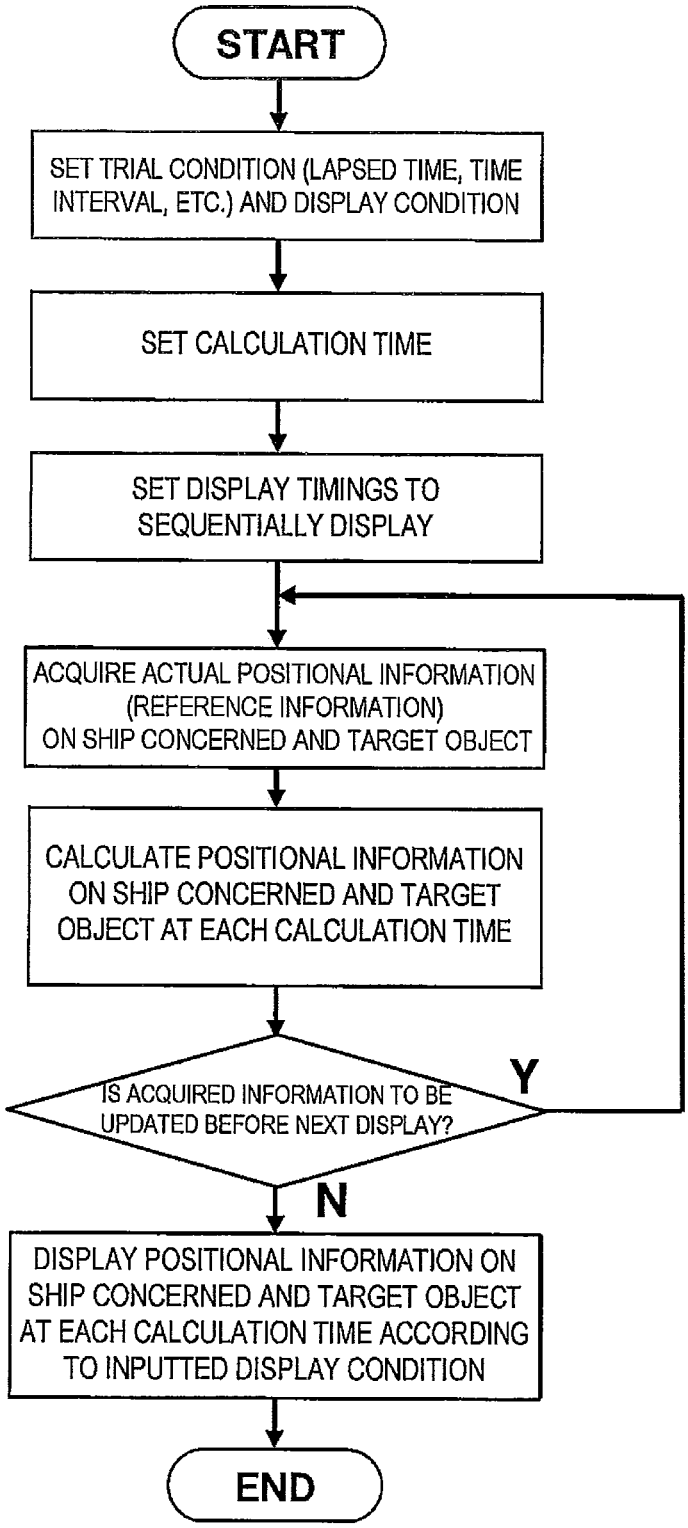
FIG. 21 is a flowchart of positional information calculation according to the navigation aid device of Embodiment 5.

Next, another embodiment of the navigation aid device will be described with reference to FIG. 20 showing its configuration and FIG. 21 showing its flowchart.

This embodiment is different from Embodiment 3 shown in FIG. 13 in that it is provided with a reference information updating module 58. In Embodiment 3, the ship-concerned information is acquired in accordance with the predetermined condition regardless of the set display points of time. On the other hand, in this embodiment, whether new ship-concerned information is to be acquired is determined in accordance with the condition of the set display points of time tm, and then, if necessary, the information is acquired. For example, if the calculation points of time are set and displayed appropriately using a trackball, the position and speed of the ship concerned do not change much when new information are acquired again after a very close display point of time. In such a case, it may be configured to avoid the unnecessary information acquisition.

Embodiment 6

Figure 22:
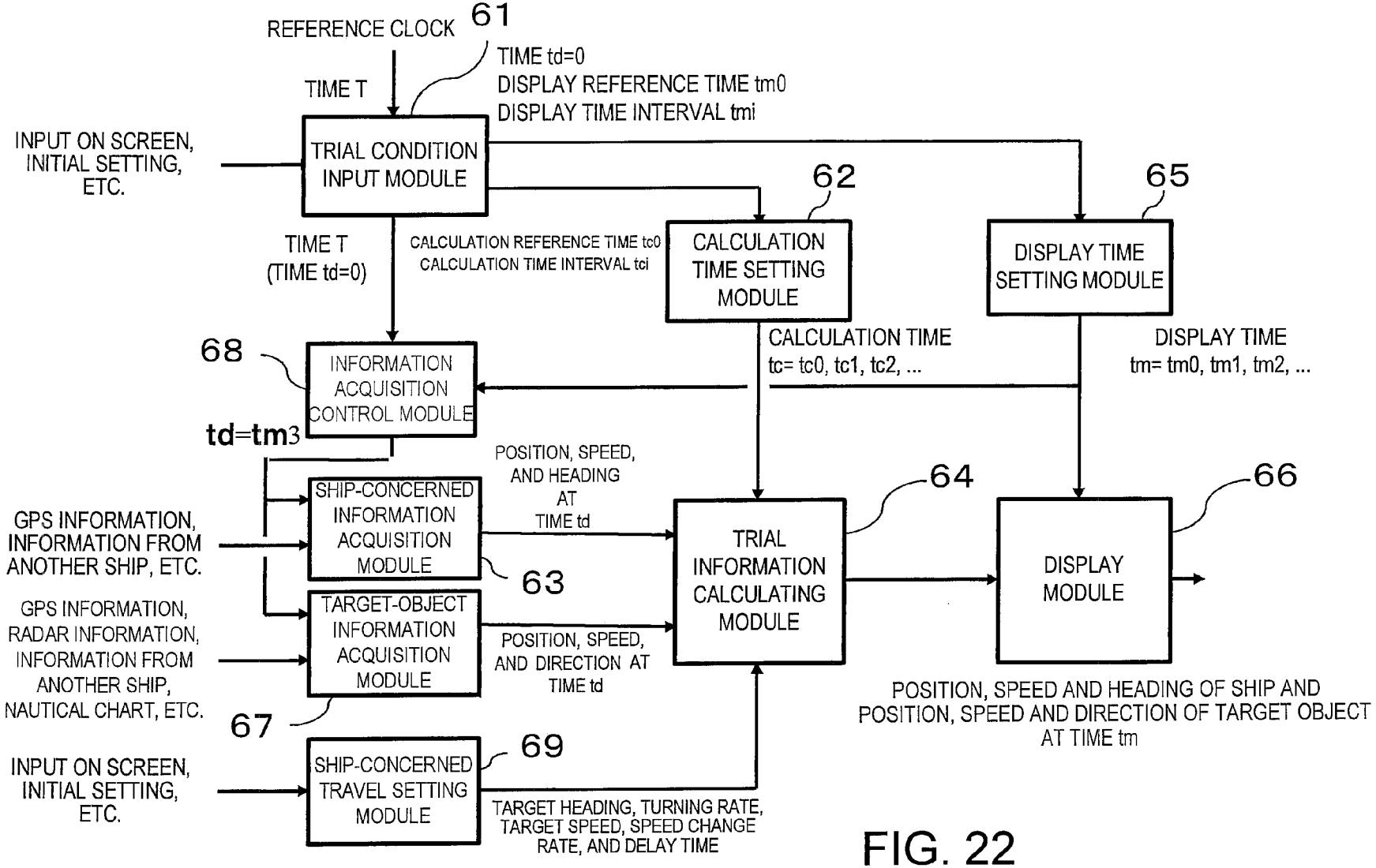
FIG. 22 is a view showing a configuration of a navigation aid device according to Embodiment 6 of the present invention.

Next, with reference to FIGS. 22 and 23, another embodiment of the navigation aid device will be described. FIG. 22 is a view showing a configuration of the navigation aid device of this embodiment, and FIG. 23 is a flowchart of positional information calculation according to this embodiment.

As contrasted with Embodiment 5 shown in FIG. 20, this embodiment is different in that a ship-concerned travel setting module 69 is additionally provided. In FIG. 22, the ship-concerned travel setting module 69 allows the ship operators to input information necessary for navigation, such as a target speed and a target heading of the ship concerned at an arbitrary time. Information on a delay of applying the target speed and the target heading from the current time may also be inputted.

Meanwhile, after the target speed and the target heading are set, it is also necessary to set a change rate of acceleration and deceleration and a change rate of course. For these information, every ship typically has unique values and are typically registered or stored in a memory in advance.

Figure 23:
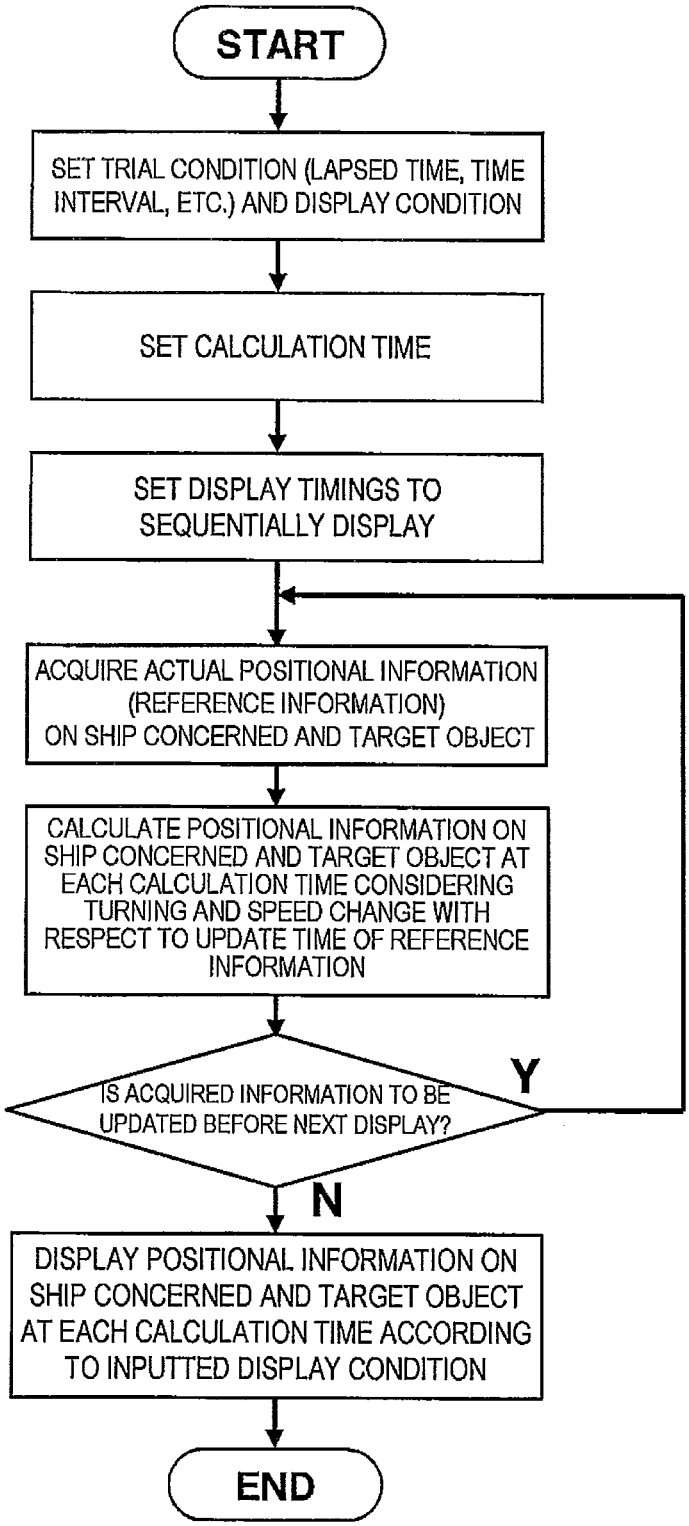
FIG. 23 is a flowchart of positional information calculation according to the navigation aid device of Embodiment 6.

The flowchart shown in FIG. 23 shows that, when navigation information (e.g., the target speed and the target heading) is changed, the position of the ship concerned at a predetermined calculation point of time tc is calculated by a trial information calculating module 64 considering the navigation information.

Figure 24:
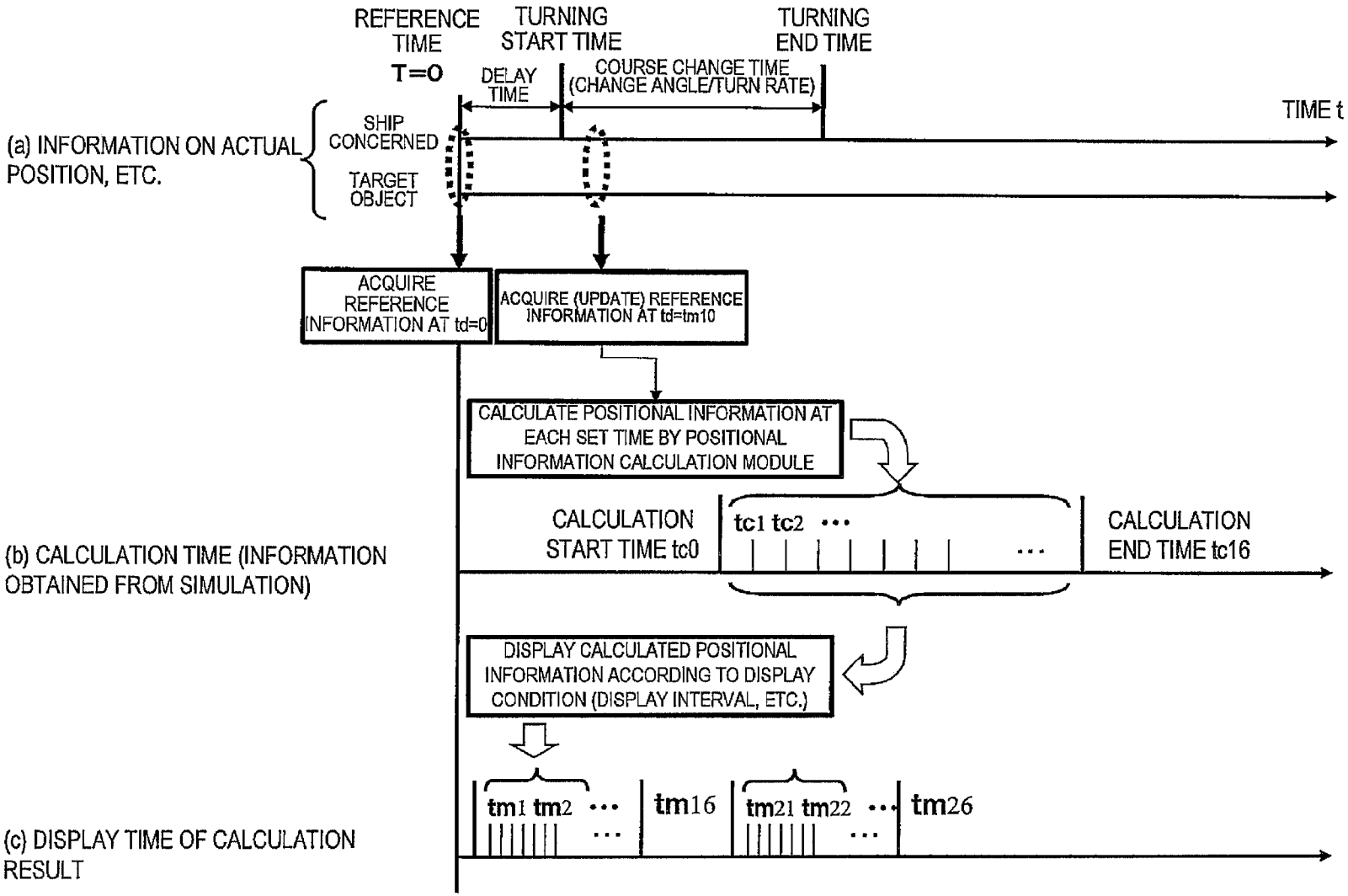
FIG. 24 is a time chart showing a relation of settings of navigation, positional calculation points of time, and display points of time according to the navigation aid device of Embodiment 6.
Figure 25:
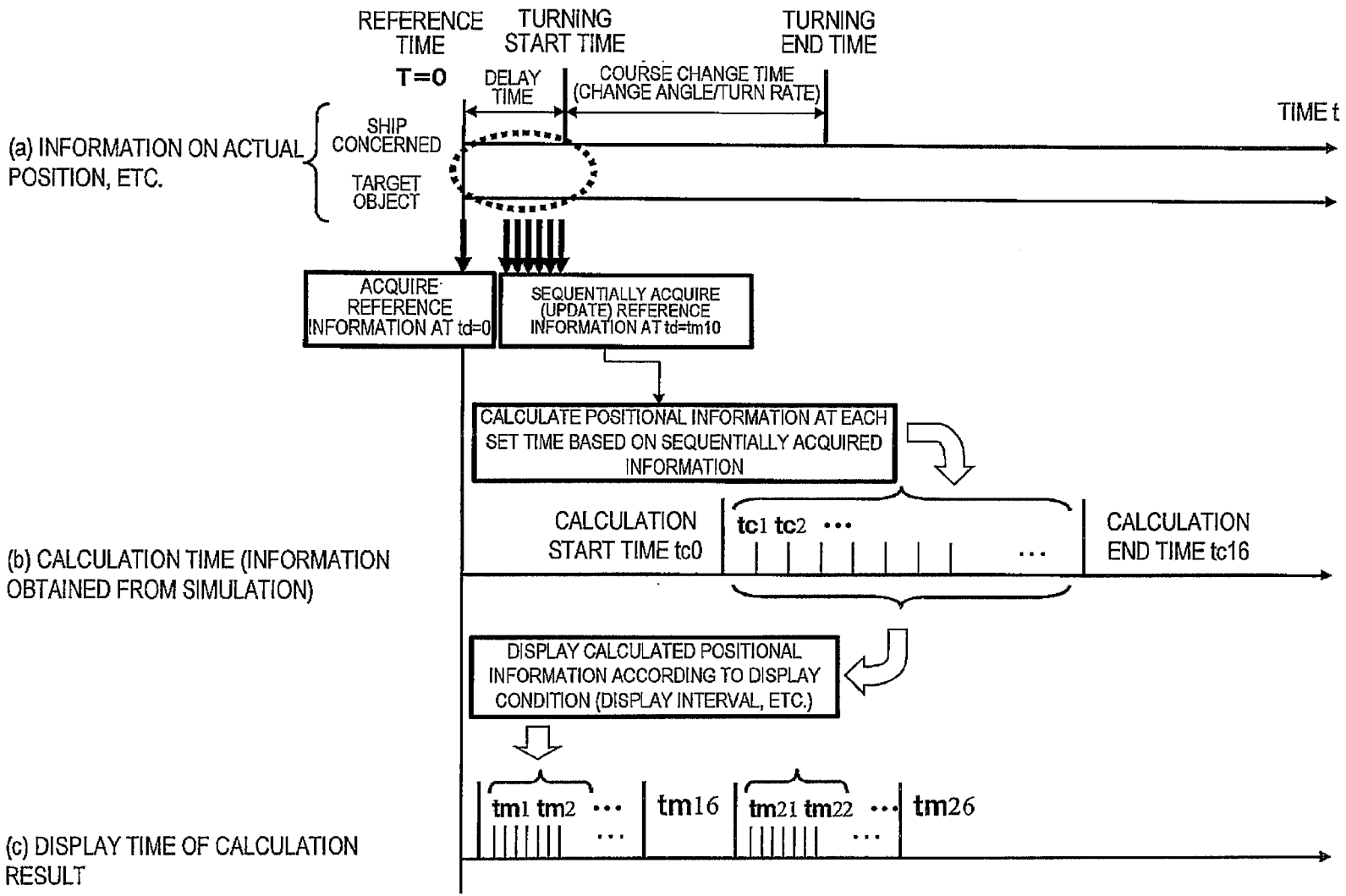
FIG. 25 is a time chart showing a relation of settings of navigation, positional calculation points of time, and display points of time according to the navigation aid device of Embodiment 6 when an acquisition condition is changed.

Both of FIGS. 24 and 25 are time charts showing a relation of settings of navigation, positional calculation points of time, and display points of time according to the navigation aid device of this embodiment. FIGS. 24 and 25 are common in FIGS. 15 and 16 for showing the time charts of the navigation aid device of Embodiment 3, respectively.

In Embodiment 3, the trial calculation is carried out, while appropriately changing the calculation points of time and the display points of time which are the results of the calculation by the trial condition input module 61. However, for the navigation information including the target speed and the target heading of the ship concerned, the trial calculation is not intended to be carried out by changing the ship's settings except for the case in which the settings change according to the result of the trial calculation. On the other hand, in this embodiment, the trial calculation can be carried out while changing the settings of navigation information on the ship concerned by the ship-concerned travel setting module 69 in addition to changing of the calculation points of time and the display points of time. Even in this case, because the necessary information, such as the positions, are calculated while always updating the information on the positions of the ship concerned and the target object, the calculation accuracy can be improved even when the trial calculation takes time.

Note that, in this embodiment, in order to simplify the description, the description is made to contrast with Embodiment 3; however, the ship-concerned travel setting module 69 may be added similarly to the configurations of other embodiments, such as Embodiment 4 or 5, for example.

Examples

Next, the results of the trial calculation of the ship concerned and the target object (e.g., another ship) according to the navigation aid device will be described with reference to display examples according to the navigation aid device of the embodiments shown in FIGS. 26 to 31. Here, the result according to the navigation aid device of Embodiment 4 shown in FIG. 17 is described. What is displayed at the center of each of FIGS. 26 to 32 is an island, and the position of the island is stored in advance in the navigation aid device as a part of a nautical chart.

Figure 26:
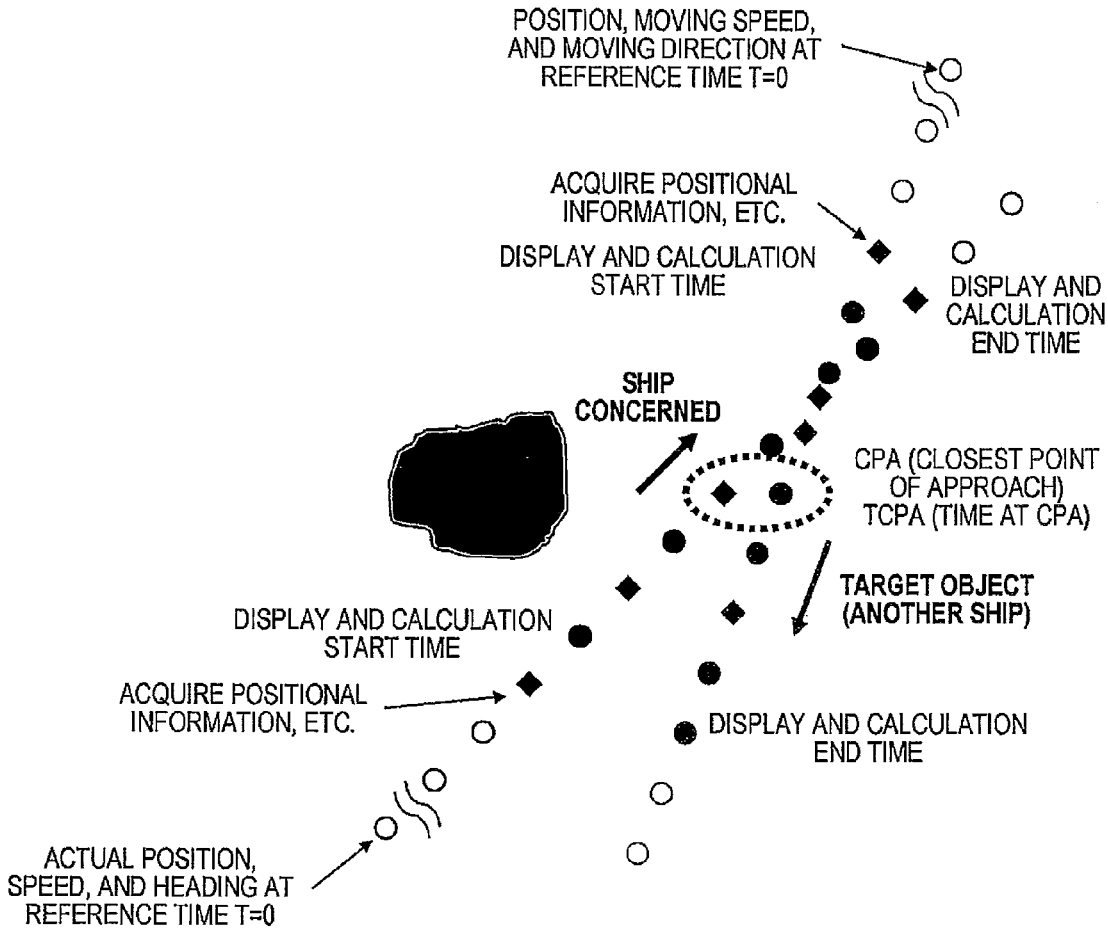
FIG. 26 is a first display example showing a spatial relationship between a ship concerned and a target object (another ship) according to the navigation aid device of Embodiments 1 through 6.

FIG. 26 is a first display example showing a spatial relationship between the ship concerned and the target object (another ship) according to the navigation aid device. In FIG. 26, the ship concerned is located at a lower left part of the drawing and another ship is located at an upper right part of the drawing at a reference time T=0 (current time). The ship concerned assumes to be traveling toward an upper right direction and another ship is traveling toward a lower left direction.

In FIG. 17, the trial calculation of the positions of both the ship concerned and another ship is carried out by the trial condition input module 41 for 8 minutes at an interval of 60 seconds after 10 minutes from the reference time, and condition settings are made so that the results of the calculation are displayed at an interval of 5 seconds from the current time.

First, the positions of both the ship concerned and another ship are calculated at the calculation point of time tc1=600 sec (here, the reference time T=tc0=0, and will be displayed based on the lapsed time from that time). Then, in order to display the calculation results immediately after that, the ship-concerned information on a position, a speed, and a heading of the ship concerned at the reference time (i.e., current time) is acquired by the ship-concerned information acquisition module 43 (the time corresponding to the symbols indicated by "◆" in the drawing). Here, the position of the ship concerned is acquired based on the GPS information and the ship speed and heading are acquired based on the information set in the ship concerned. Further, a position, a moving speed, and a moving direction of another ship are acquired based on the radar and AIS information.

After 60 seconds from the first display, the trial calculations are carried out for the positions of the ship concerned and another ship at an interval of 5 seconds, and the calculation results are displayed. Here, the necessary information on the ship concerned and another ship is newly acquired for display information at next 10 seconds (i.e., 10 seconds after the first information acquisition) (the second "◆" from the lower left in the drawing). Similarly, for the display information at 10 seconds later and 15 seconds later, the positions of the ship concerned and another ship are calculated based on the newly acquired information. The time acquisition of the ship-concerned information and another-ship information and the trial calculations based on these information are repeated similarly.

The positions calculated without acquiring the ship-concerned information necessary for the trial calculation at the time concerned are indicated by "●" in the drawing. This display example shows the case where the acquisition time of the ship-concerned information (10-second cycle) differs from the acquisition time of another-ship information (25-second cycle).

As shown in FIG. 26, the results of the spatial relationship of the ship concerned and another ship at an interval of 60 seconds from 600 seconds later starting from the current time up to 1080 seconds later are sequentially displayed by the display module 16 at an interval of 5 seconds. From the results of the trial calculation, it can be seen that the spatial relationship between the ship concerned and another ship traveling from the upper right will be the Closest Point of Approach (CPA) at approximately 840 seconds from the current time.

Figure 27:
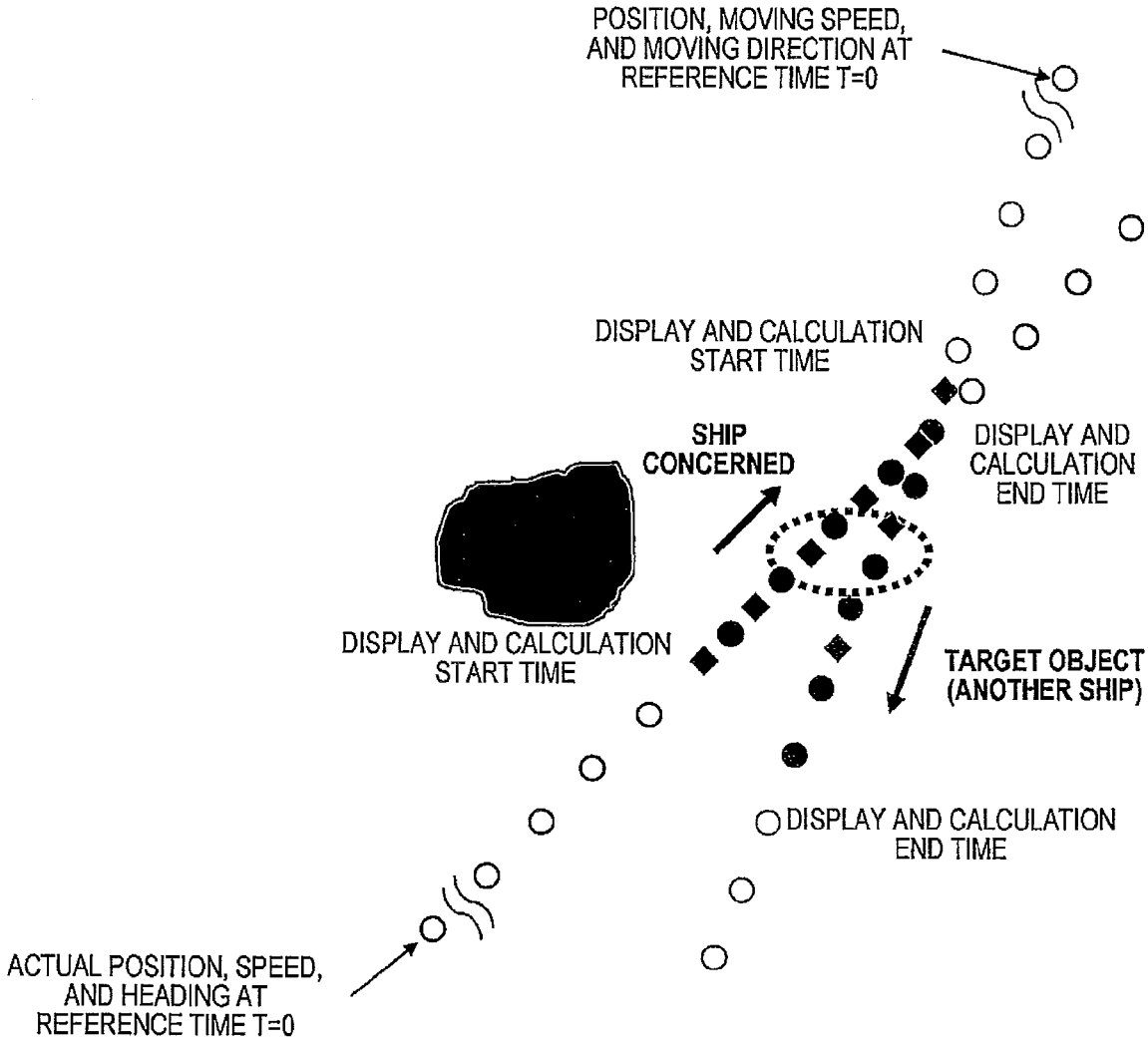
FIG. 27 is a second display example showing a spatial relationship between a ship concerned and a target object (another ship) according to the navigation aid device of Embodiments 1 through 6.

FIG. 27 is second display example showing a spatial relationship between the ship concerned and the target object (another ship) according to the navigation aid device of this embodiment.

Figure 28:
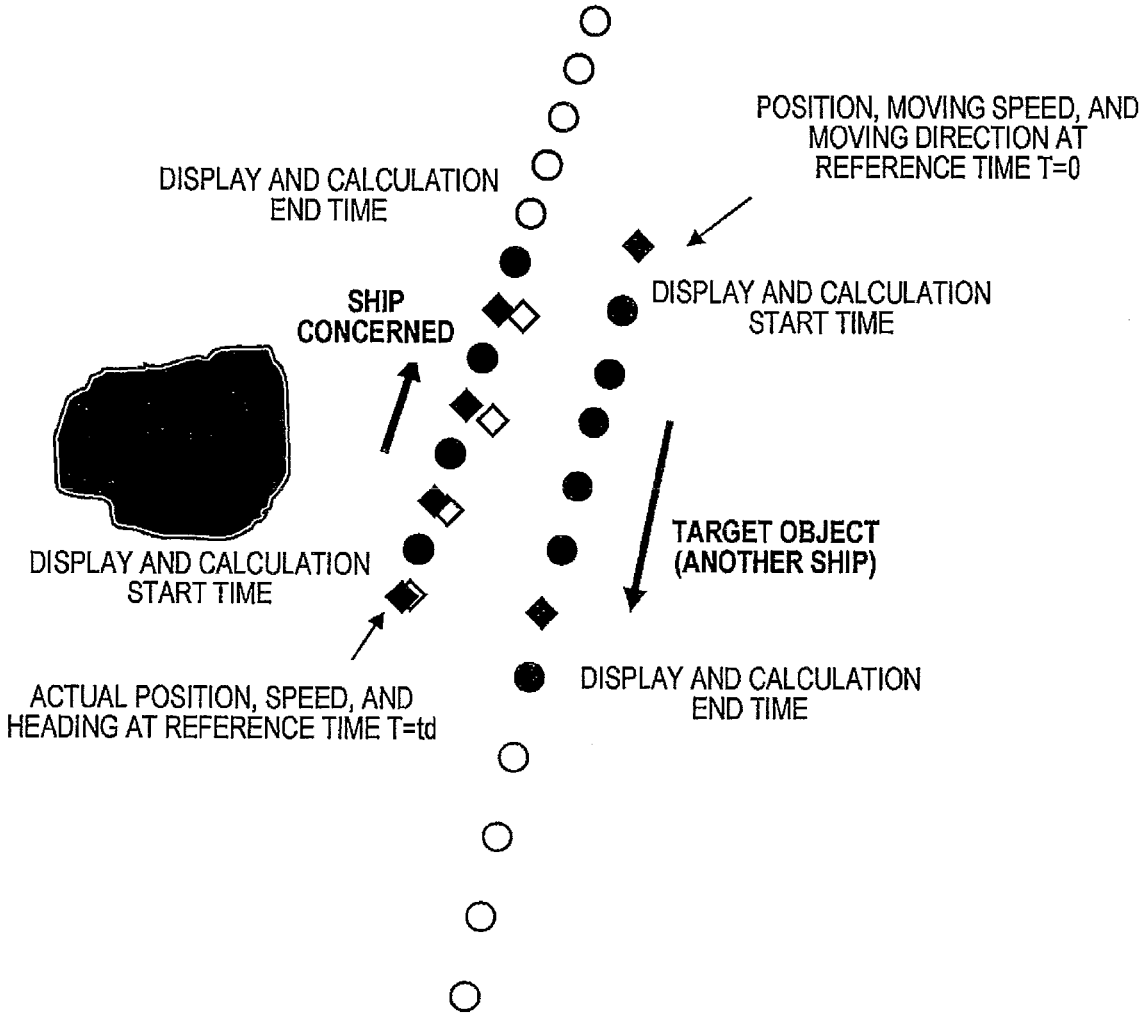
FIG. 28 is a third display example showing a spatial relationship between a ship concerned and a target object (another ship) according to the navigation aid device of Embodiments 1 through 6.
Figure 29:
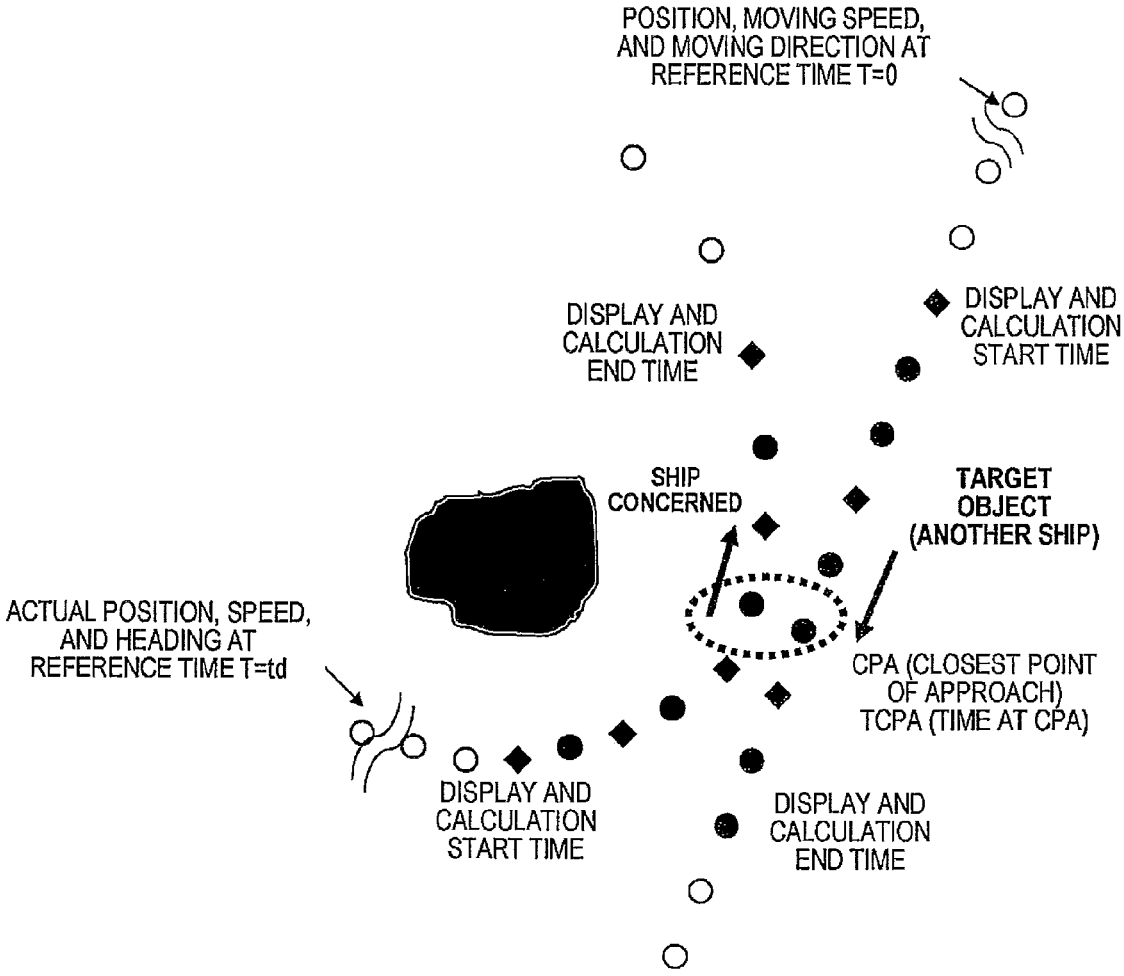
FIG. 29 is a fourth display example showing a spatial relationship between a ship concerned and a target object (another ship) according to the navigation aid device of Embodiments 1 through 6.

FIG. 28 shows a display example of the result at the time of carrying out the trial calculation based on the result acquired by FIG. 29, focused on near the Time of the Closest Point of Approach (TCPA). Here, the start time of the trial calculation is set to 690 second later from the current time, and the trial calculations are repeated at an interval of 30 seconds. It can be seen that TCPA will come 810 seconds later.

FIG. 28 is a third display example showing a spatial relationship between the ship concerned and the target object (another ship) according to the navigation aid device of this embodiment.

FIG. 28 shows the results of the trial calculations based on the results of the trial calculations shown in FIG. 27, while changing the target heading of the ship concerned. Here, upon performing the trial calculation again, the ship-concerned information is newly acquired. What are shown by symbols "◇" in the drawing indicate the results of the trial calculations based on the ship-concerned information used for the trial calculations shown in FIG. 27, but only conditions are changed.

In fact, when newly carrying out the trial calculation, the actual heading of the ship concerned may have already been changed. Therefore, as shown in the drawing, the new results of the trial calculation may differ from the actual result. According to the navigation aid device of this embodiment, because the positions of the ship concerned and the target object are calculated while acquiring the newest positional information during the trial calculation, more accurate trial calculation is possible.

Figure 30:
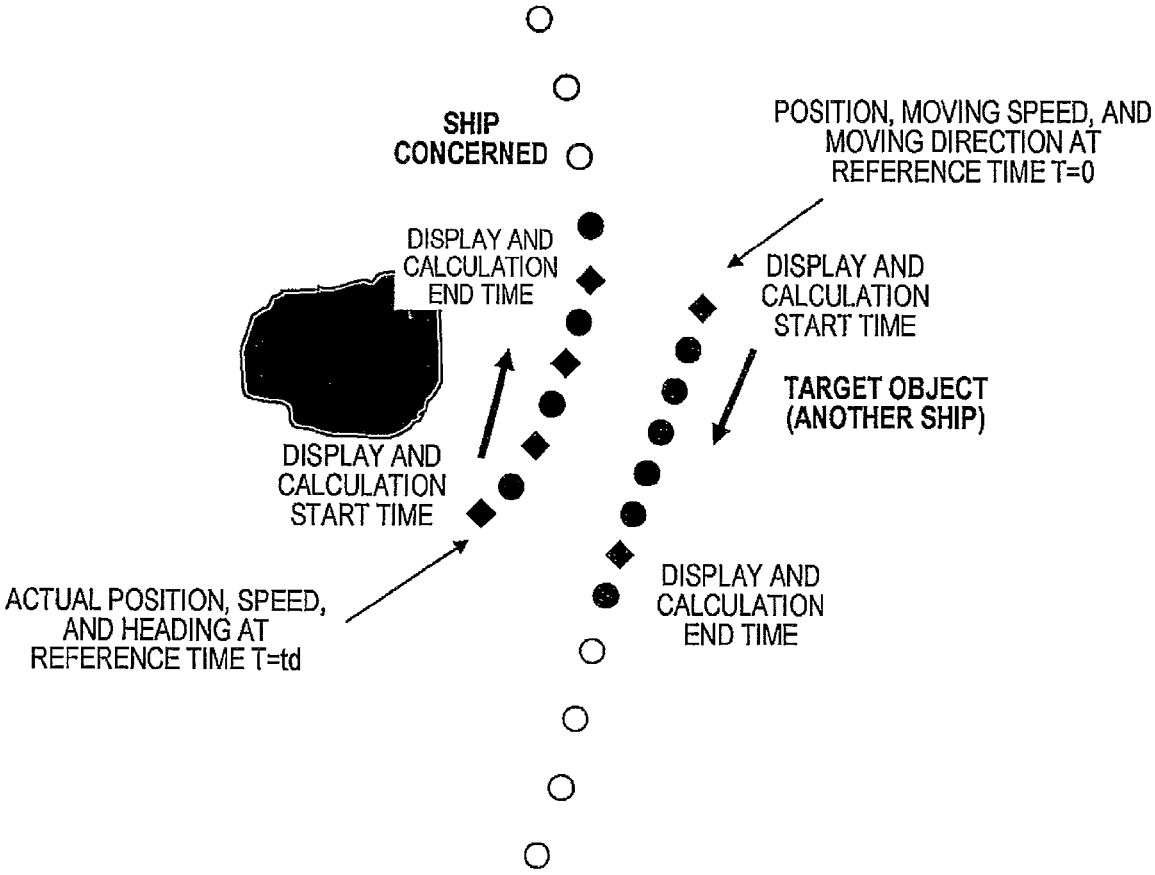
FIG. 30 is a fifth display example showing a spatial relationship between a ship concerned and a target object (another ship) according to the navigation aid device of Embodiments 1 through 6.

FIGS. 29 to 30 are the fourth through sixth display examples showing spatial relationships between the ship concerned and the target object (another ship) according to the navigation aid device of this embodiment. The display examples shown in FIGS. 29 to 30 are based on the configuration of Embodiment 3 shown in FIG. 11, and show the results of the trial calculations by the configuration provided with the ship-concerned travel setting module 69 shown in FIG. 22.

Figure 31:
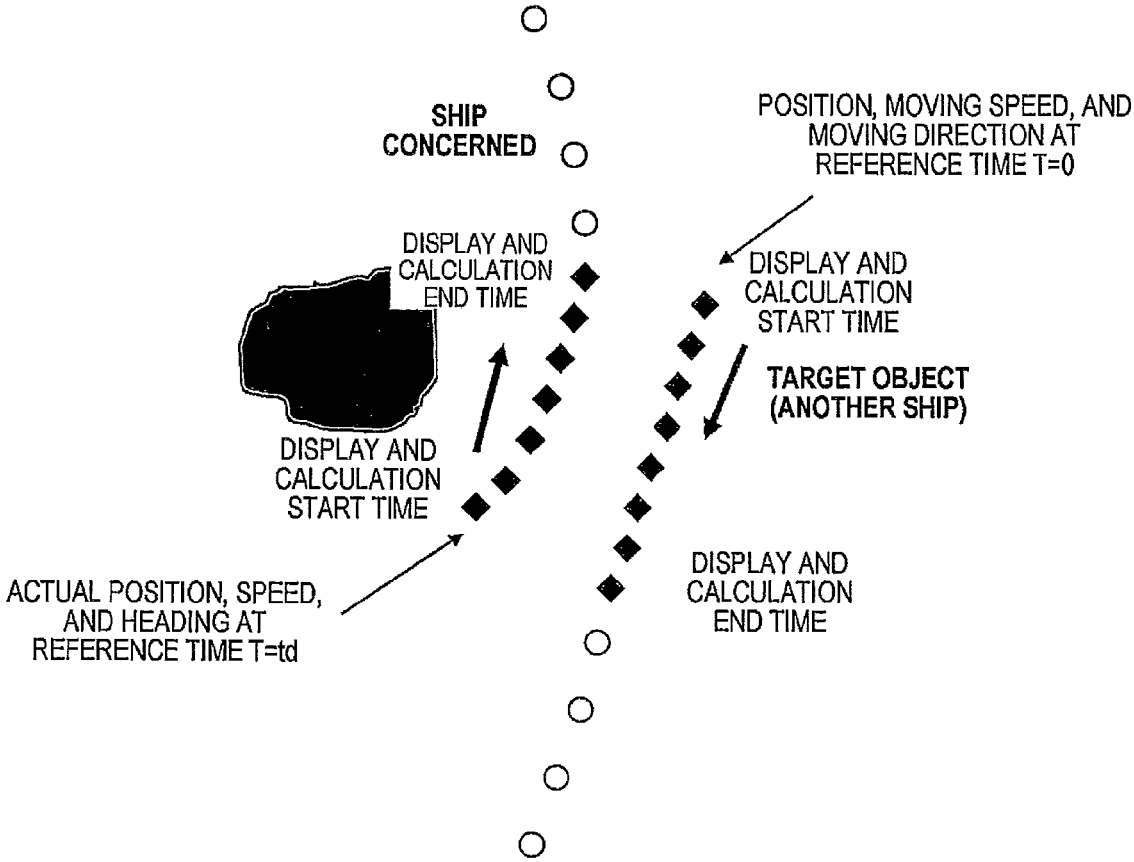
FIG. 31 is a sixth display example showing a spatial relationship between a ship concerned and a target object (another ship) according to the navigation aid device of Embodiments 1 through 6.

In the display examples shown in FIGS. 26 to 28, settings of the calculation points of time are performed by determining the start time and the time interval described above in advance and inputting these. On the other hand, in the fourth through sixth display examples of FIGS. 29 to 30, by using a trackball and rotating it by an external force, the calculation points of time and the time interval are set corresponding to the moving length of the trackball perimeter to carried out the trial calculation. Thus, FIGS. 29 to 31 show the results of the trial calculations while further setting the target speed and the target heading of the ship concerned by the ship-concerned travel setting module, as well as setting arbitrary calculation points of time using the trackball.

FIGS. 29 and 30 show the results the trial calculation performed under the same condition of the calculation points of time as the trial calculations shown in FIGS. 26 and 27, respectively. The trial calculation shown in FIG. 30 shows the results of the trial calculation with the time interval of the calculation points of time being an half in order to examine the vicinity of CPA in detail based on the results of the trial calculation shown in FIG. 29.

In FIG. 30, the ship-concerned information is acquired at every two displays (each display occurs at every 5 seconds), the another-ship information is acquired at every three displays to carry out the trial calculations. On the other hand, in the display example shown in FIG. 31, the information on both the ship concerned and the target object are acquired for every trial calculation necessary for the display. Because the calculation is based on the newest ship-concerned information and the newest another-ship information even if calculating the positions of the ship concerned by determining the next display each time with the trackball, more accurate trial calculation can be achieved.

Embodiment 7

Hereinbelow, another embodiment of the navigation aid device will be described with reference to FIG. 32.

Figure 32:
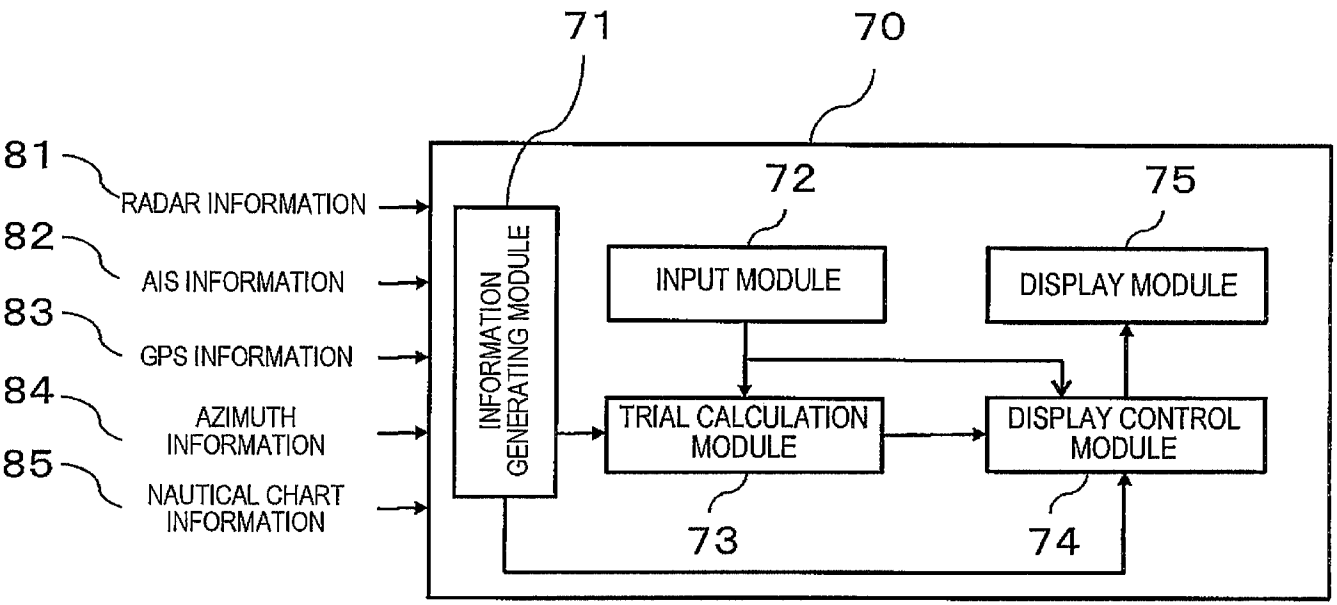
FIG. 32 is a view showing a configuration of a navigation aid device according to Embodiment 7 of the present invention.

In FIG. 32, the reference numeral "70" indicates the navigation aid device of this embodiment, and it includes an information generating module 71, an input module 72, a trial calculation module 73, a display control module 74, and a display module 75.

The information generating module 71 generates positions, speeds, and moving directions of the ship concerned and the target object to be an obstacle candidate. Here, the positions of the ship concerned and the obstacle candidate may be generated and managed by absolute positions, or the position of the obstacle candidate may be generated and managed by a relative position with respect to the ship concerned. If managing by the absolute positions, the position and the speed of the ship concerned can be generated using GPS information 83 from a GPS positioning device and the position of another ship can be generated based on AIS information 82 received from another ship.

If managing by the relative positions with respect to the ship concerned, the position of the obstacle candidate can be generated based on radar information 81. In this case, a velocity vector of the ship concerned is generated using the GPS information 83 and azimuth information 84 from a compass device. A velocity vector of another ship among the obstacle candidates can be obtained from the AIS information 82. Alternatively, the velocity vector of another ship may be generated based on the velocity vector of the ship concerned and time-sequential changes of the obstacle candidate acquired from the radar information 81.

A position of the obstacle candidate which do not move (i.e., stationary), such as a coastline or non-route ocean area, can be generated based on nautical chart information. Here, the radar information 81 may be information acquired from an Automatic Radar Plotting Aids (ARPA), or may be used together with the radar information 81. When using the information from the ARPA and a collision alert is included in the information, the information may be transmitted to the display control module 74 via the information generating module 71.

The input module 72 is a module at which input settings of information, such as a trial calculation request signal for requiring to perform trial calculation for estimating spatial relationships between the ship concerned and another ship at arbitrary future points of time, lapsed times from the trial calculation, and collision preventive conditions for collision preventive action plans, are carried out based on the information from the information generating module 71. Here, by the input of the lapsed time from the trial calculation, an evading maneuver state of the ship concerned against the obstacle (closest approach distance and its time) can be observed easily and quickly by using an input device, such as the trackball.

From the input module 72, obstacle selection information for selectively extracting an obstacle object to limit the obstacle object to perform the trial calculation among the obstacle candidates from the information generating module 71 may be inputted. This obstacle selection information may be inputted using a touch-panel display screen of the display module 75.

When the trial calculation request signal is received from the input module 72, the trial calculation module 73 performs the trial calculation of the spatial relationship between the ship concerned and the obstacle at an arbitrary lapsed time from the current time based on the information from the information generating module 71. Besides the spatial relationship between the ship concerned and the obstacle candidate, the trial calculation module 73 also calculates and displays the closest approach distance and the closest approach time. Although the trial calculation by the trial calculation module 73 may be started in response to the trial calculation request signal by the ship operators, it may be started in response to a signal generated based on external information, such as ARPA, for example.

In a trial calculation display mode for displaying the trial calculation results, the display control module 74 generates display data for displaying the spatial relationship between the ship concerned and the obstacle calculated by the trial calculation module 73 and its control signal. In a normal display mode, the display control module 74 generates display data for displaying the information generated by the information generating module 71 and its control signal.

The display module 75 displays the display data generated by the display control module 74 according to the trial calculation display mode or the normal display mode. In the trial calculation display mode, every time inputting the lapsed time, the display of the position of the ship concerned and the obstacle at the last-inputted lapsed time display and the display of the position at the past lapsed time can be discriminated from each other by any of their color phases, chroma saturation, and brightness. However, in this case, the trial calculation result of the lapsed time for every input is stored in the trial calculation module 73 or the display control module 74. The display control module 74 may be necessarily added with a control function so that the trial calculation result of every lapsed time can be identified.

That is, in order to be able to observe the ship concerned S and the obstacle object T1 in detail, it is necessary to set Δt small. On the other hand, if Δt is made smaller and if the time in which the ship operators are highly interested is quite far future from the start of the trial calculation, previous t(i), the validity of the collision preventive action plan cannot be evaluated until time comes after the start. This waiting time is determined by (t(i)/Δtx*display update period Td). It may be difficult for the operators to keep staring at the display screen until the arrival of the time, while the ship traveling in a congested ocean area. In order to reduce the waiting time, the display update period Td must be made smaller. By doing this, the most interesting time for the ship operators can be reduced. However, because the trial position at the lapsed time t(i) is displayed only for a very short period of time, the ship operators cannot observe the position in plenty of time.

In order to avoid this disadvantage, it is possible to change the lapsed time Δt and the display update period Td in the middle of the trial calculation for the collision prevention. However, this change is not preferred because the display before and after the change will be discontinuous to make the evaluation even difficult.

In the single epoch display method, only the trial position after a time to be determined by data, such as a turning rate (degree/second) and a speed change rate (knot/second) stored in advance as transcendental information unique to the ship, is calculated and, thus, a relative spatial relationship between the ship concerned and the obstacle before and after that time cannot be displayed. For this reason, at the most interesting time (or place) for the ship operators, it cannot evaluate and check correctly about how much safely the ship concerned can avoid the obstacle.

Because the conventional ARPA detects an obstacle automatically during the travel of the ship concerned, and an alert is issued or displayed at the time of detection, the ship operators perform evading maneuver after receiving the alert. For this reason, the ship operators cannot determine whether an object will be an obstacle. In addition, the detection of an obstacle which requires the evading maneuver is significantly dependent on the obstacle detection performance of ARPA.

Examples

Next, the display examples of the trial calculation result are described with reference to FIGS. 33 and 34.

Figure 33:
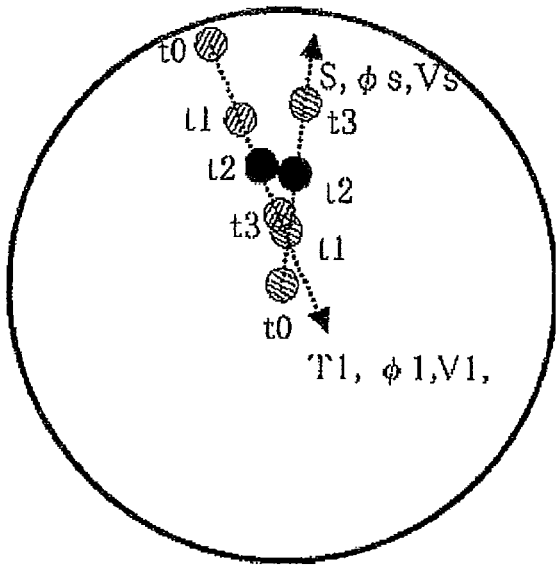
FIG. 33 is a view showing a display example according to the navigation aid device of Embodiment 7.

FIG. 33 is a display example of the trial calculation result for checking the requirement of the collision preventive action when the ship concerned S is traveling to a heading ϕs and at a speed Vs, and another ship T1 is traveling to a heading ϕ1 and at a speed V1 at the t0 epoch. When performing the trial calculation for checking the collision preventive action requirement, the ship operators do not normally know the most interesting lapsed time input value. Now, it is assumed that the ship operators inputted a lapsed time t1. It cannot be determined at the lapsed time t1 whether the ship concerned S will collide with another ship T1 based on the positions (positional relation) of the ship concerned S and the another ship T1 or how far the ship concerned can avoid the another ship.

In such a case, in this embodiment, following the input value t1 of the lapsed time, t2 and t3 are inputted, the trial calculation module 73 performs the trial calculations of the positions of the ship concerned S and another ship T1 corresponding to t2 and t3 to display the calculation results. As a result, the ship operators can visually determine easily whether the ship concerned S will collide with another ship T1, or how far the ship concerned can avoid another ship T1.

Figure 34:
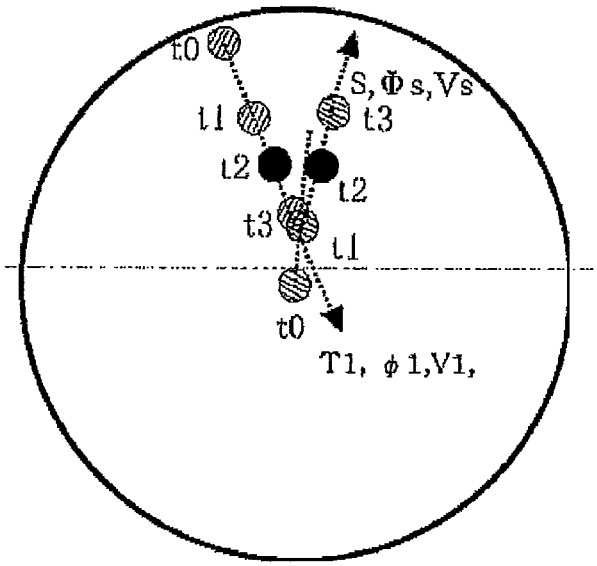
FIG. 34 is a view showing another display example according to the navigation aid device of Embodiment 7.

In the case of FIG. 34, it can be visually recognized that the closest approach will occur after lapse of the time t2 from the t0 epoch. Although not illustrated in FIG. 34, the closest approach distance of the ship concerned S and another ship T1 and its occurring time are also calculated by the trial calculation module 73 to display them by the display module 75. The input value of the lapsed time may be set continuously or discretely by a predetermined time width.

As a result of the trial calculation for checking the collision preventive action requirement, if the trial calculation for the collision preventive action plan has to be performed for evading maneuver, at least any of the course and speed of the ship concerned, and the trial start time is inputted. For the variable of which settings changed, they are calculated for another ship T1 and the ship concerned S at each lapsed time, and the results are displayed by the display module 75.

FIG. 33 is a display example of the trial calculation result for the collision preventive action plan at the time of setting the lapsed time t1 from the t0 epoch as the trial start time, and changing the course of the ship concerned from ϕ1 to ϕs at the trial start time. In this case, the lapsed time can be set as either of the lapsed time from the t0 epoch or the lapsed time from the trial start time.

Also in the case of the trial calculation for the collision preventive action plan, similar to the case of the trial calculation for checking the collision preventive action requirement, the positions of another ship T1 and the ship concerned S are calculated at the lapsed time which can be set as an arbitrary value to enable the display of these positions. As a result, the settings of the collision preventive action plan and their validity will be easy checked.

FIG. 34 shows the trial calculation results of the lapsed times t2 and t3 with respect to the set value t1 of a certain trial start time. The positions of another ship T1 and the ship concerned S can be calculated for the value obtained by setting at least any of the course and the speed of the ship concerned and the trial start time continuously or discretely, and these positions can be displayed.

In FIGS. 33 and 34, the positions of the ship concerned and the obstacle after the start of the trial calculation are displayed so that they shift for every lapsed time. Alternatively, the display center may always be set as the position of the ship concerned, and the positions of the obstacle with respect to the position of the ship concerned may be displayed for every lapsed time.

According to the embodiments above, for example, the trial calculation for checking the collision preventive action requirement or the collision preventive action plan can be carried out by the ship operators' own determination without depending on the collision preventive warning (including disturbed zones by other ships) information from an external device, such as ARPA. Especially, by the ship operators inputting their interesting time using an input device, such as a trackball, the spatial relationship between the ship concerned and the obstacle at an arbitrary lapsed time and the time before and after that can be displayed simply and quickly as the results.

In the embodiments, because the ship operators selectively extracts an obstacle object from a displayed image and causing to perform the trial calculation for checking the collision preventive action requirement for the extracted obstacle object and then to display the calculated results, it makes easier to determine the collision preventive action requirement. Also for the collision preventive action plan created by various combination of the course and speed of the ship concerned and their change time, the ship operators can cause the calculation of the positions of the ship concerned and the obstacle at the most interesting lapsed time and before and after that, and to display the results. Thereby, the optimal collision preventive action plan can be determined quickly.

In the foregoing specification, particular embodiments of the present invention have been described. However, one of ordinary skill in the art appreciates that various modifications and changes can be made without departing from the scope of the present invention as set forth in the claims below. Accordingly, the specification and figures are to be regarded in an illustrative sense rather than a restrictive sense, and all such modifications are intended to be included within the scope of the present invention. The benefits, advantages, solutions to problems, and any element(s) that may cause any benefit, advantage, or solution to occur or become more pronounced are not to be construed as critical, required, or essential features or elements of any or all the claims. The invention is defined solely by the appended claims including any amendments made during the pendency of this application and all equivalents of those claims as issued.

Moreover in this document, relational terms such as first and second, top and bottom, and the like may be used solely to distinguish one entity or action from another entity or action without necessarily requiring or implying any actual such relationship or order between such entities or actions. The terms "comprises," "comprising," "has," "having," "includes," "including," "contains," "containing" or any other variation thereof, are intended to cover a non-exclusive inclusion, such that a process, method, article, or apparatus that comprises, has, includes, contains a list of elements does not include only those elements but may include other elements not expressly listed or inherent to such process, method, article, or apparatus. An element proceeded by "comprises . . . a," "has . . . a," "includes . . . a," "contains . . . a" does not, without more constraints, preclude the existence of additional identical elements in the process, method, article, or apparatus that comprises, has, includes, contains the element. The terms "a" and "an" are defined as one or more unless explicitly stated otherwise herein. The terms "substantially," "essentially," "approximately," "about" or any other version thereof, are defined as being close to as understood by one of ordinary skill in the art, and in one non-limiting embodiment the term is defined to be within 10%, in another embodiment within 5%, in another embodiment within 1% and in another embodiment within 0.5%. The term "coupled" as used herein is defined as connected, although not necessarily directly and not necessarily mechanically. A device or structure that is "configured" in a certain way is configured in at least that way, but may also be configured in ways that are not listed.

What is claimed is:

1. A navigation aid device, comprising:

a calculation time setting module for setting two or more calculation points of time for calculating trial information;

a ship-concerned information acquisition module for acquiring ship-concerned information including a position of a ship concerned at every predetermined ship-concerned information acquisition time;

a ship-concerned trial information calculating module for calculating ship-concerned trial information including future positions of the ship concerned at the respective two or more calculation points of time based on the most-recently acquired ship-concerned information;

a display module for simultaneously displaying on a screen the future positions of the ship concerned so as to correspond to respective positions on the screen;

a target-object information acquisition module for acquiring target-object information including a position of a target object other than the ship concerned at every predetermined target-object information acquisition time; and a target-object trial information calculating module for calculating target-object trial information including future positions of the target object at the respective two or more calculation points of time based on most-recently acquired target-object information;

wherein the display control module causes the display module to simultaneously display the future positions of the target object at the respective two or more calculation points of time, the future positions of the target object being displayed so as to correspond to respective positions on the screen.

2. The navigation aid device of claim 1, further comprising:

a display time setting module for setting a display point of time at which the future position of the ship concerned is displayed so as to correspond to each calculation point of time; and a display control module for causing the display module to display at each display point of time the future position of the ship concerned at each calculation point of time corresponding to the display point of time.

3. The navigation aid device of claim 2, wherein the ship-concerned information acquisition module acquires the ship-concerned information before each display point of time.

4. The navigation aid device of claim 1, wherein the target-object information acquisition module acquires the target-object information before each display point of time.

5. The navigation aid device of claim 4, further comprising an information acquisition control module for controlling whether the ship-concerned information acquisition module and the target-object information acquisition module acquire the ship-concerned information and the target-object information before each display point of time, respectively.

6. The navigation aid device of claim 5, wherein the ship-concerned information includes at least one of a speed and a bearing of the ship concerned.

7. The navigation aid device of claim 6, further comprising a ship-concerned travel setting module for setting information including a target speed and target heading of the ship concerned at an arbitrary time.

8. The navigation aid device of claim 7, wherein the target-object information includes at least one of a moving speed and a moving direction of the target object.

9. The navigation aid device of claim 8, wherein the target-object information acquisition module includes a stationary target object memory module for storing a position of a stationary target object, the position of which does not change with time.

10. The navigation aid device of claim 9, wherein the ship-concerned information acquisition module includes:

a ship-concerned information input module for inputting the ship-concerned information; and a ship-concerned information storing module for storing the ship-concerned information and outputting the ship-concerned information according to a request from the ship-concerned trial information calculating module.

11. The navigation aid device of claim 10, wherein the target-object information acquisition module includes:

a target-object information input module for inputting the target-object information; and a target-object information storing module for storing the target-object information and outputting the target-object information according to a request from the target-object trial information calculating module.

12. The navigation aid device of claim 11, further comprising an alert determination module for comparing a ship-concerned/target-object relation defined by information including the position of the ship concerned and the position of the target object at each calculation point of time with an alert condition including a predetermined spatial relationship between the ship concerned and the target object, and outputting a signal when the ship-concerned/target-object relation falls under the alert condition.

13. The navigation aid device of claim 12, wherein the ship-concerned/target-object relation includes a course of the ship concerned and a moving direction of the target object in addition to the position of the ship concerned and the position of the target object.

14. The navigation aid device of claim 13, wherein the display module displays the position of the target object fell under the alert condition at a calculation point of time when the ship-concerned/target-object relation falls under the alert condition based on the signal so that the position of the target object can be discriminated form a displayed position of the target object at another calculation point of time.

15. The navigation aid device of claim 1, wherein the calculation time setting module sets the calculation point of time based on a calculation time interval from a calculation start time at which the calculation starts and a calculation start time defined by the reference time and a lapsed time, or based on the reference time and a lapsed time from the reference time.

16. The navigation aid device of claim 15, wherein the calculation time setting module includes:

an object moving module for causing a movement of a peripheral part of a cylindrical or spherical object in response to an external force being applied; and a time setting module for setting the lapsed time and the calculation time interval corresponding to an amount of the movement to set the calculation point of time.

17. A navigation aid method, comprising:

setting two or more calculation points of time for calculating trial information;

acquiring ship-concerned information including a position of a ship concerned at every predetermined ship-concerned information acquisition time;

calculating ship-concerned trial information including future positions of the ship concerned at the respective two or more calculation points of time based on the most-recently acquired ship-concerned information;

simultaneously displaying on a screen the future positions of the ship concerned so as to correspond to a display position;

acquiring target-object information including a position of a target object other than the ship concerned at every predetermined target-object information acquisition time; and calculating target-object trial information including future positions of the target object at the respective two or more calculation points of time based on most-recently acquired target-object information;

wherein the future positions of the target object at the respective two or more calculation points of time are simultaneously displayed on the screen, the future positions or the target object being displayed so as to correspond to respective positions on the screen.

18. The navigation aid method of claim 17, further comprising:

acquiring target-object information including a position of a target object other than the ship concerned at every predetermined target-object information acquisition time;

calculating target-object trial information including future positions of the target object at the respective two or more calculation points of time based on the most-recently acquired target-object information; and simultaneously displaying with the future positions of the ship concerned the future positions of the target object.

19. A non-transitory computer-readable medium on which is stored a navigation aid program which, when executed by a computer, causes a computer to perform a process comprising:

inputting two or more calculation points of time for calculating trial information;

inputting ship-concerned information including at least one of a position, a speed, and a bearing of a ship concerned at every predetermined ship-concerned information acquisition time;

calculating ship-concerned trial information including future positions of the ship concerned at the respective two or more calculation points of time based on the most-recently acquired ship-concerned information; and inputting target-object information including at least one of a position, a moving speed, and a moving direction of a target object other than the ship concerned at every predetermined target-object information acquisition time;

calculating target-object trial information including future positions of the target object at the respective two or more calculation points of time based on the most-recently acquired target-object information;

simultaneously displaying on a screen the future positions of the ship concerned and the target object so as to correspond to respective positions on the screen;

acquiring target-object information including a position of a target object other than the ship concerned at every predetermined target-object information acquisition time; and calculating target-object trial information including future positions of the target object at the respective two or more calculation points of time based on most-recently acquired target-object information;

wherein the future positions of the target object at the respective two or more calculation points of time are simultaneously displayed on the screen, the future positions or the target object being displayed so as to correspond to respective positions on the screen.

* * * * *